US010984698B2

(12) United States Patent
Shin et al.

(10) Patent No.: US 10,984,698 B2
(45) Date of Patent: Apr. 20, 2021

(54) METHOD OF PERFORMING AN IMAGE-ADAPTIVE TONE MAPPING AND DISPLAY DEVICE EMPLOYING THE SAME

(71) Applicant: Samsung Display Co., Ltd., Yongin-si (KR)

(72) Inventors: Jihye Shin, Cheonan-si (KR); Seungho Park, Suwon-si (KR); Seonhaeng Kim, Seoul (KR)

(73) Assignee: SAMSUNG DISPLAY CO., LTD.

( * ) Notice: Subject to any disclaimer, the term of this patent is extended or adjusted under 35 U.S.C. 154(b) by 0 days.

(21) Appl. No.: 16/292,585

(22) Filed: Mar. 5, 2019

(65) Prior Publication Data

US 2019/0279549 A1 Sep. 12, 2019

(30) Foreign Application Priority Data

Mar. 6, 2018 (KR) ..... 10-2018-0026541

(51) Int. Cl.
*G09G 3/20* (2006.01)
*G09G 3/3208* (2016.01)
*G09G 3/36* (2006.01)

(52) U.S. Cl.
CPC ..... *G09G 3/2007* (2013.01); *G09G 3/3208* (2013.01); *G09G 3/3607* (2013.01); *G09G 2320/0247* (2013.01); *G09G 2320/066* (2013.01); *G09G 2320/0686* (2013.01); *G09G 2320/103* (2013.01); *G09G 2340/16* (2013.01)

(58) Field of Classification Search
CPC .. G09G 3/2007; G09G 3/3607; G09G 3/3208; G09G 2320/103; G09G 2320/066; G09G 2320/0686; G09G 2320/0247; G09G 2320/0271; G09G 2320/0626; G09G 2340/16; G09G 2340/06
See application file for complete search history.

(56) References Cited

U.S. PATENT DOCUMENTS

| | | | | |
|---|---|---|---|---|
| 7,068,841 | B2 * | 6/2006 | Luo | G06T 5/007 382/167 |
| 7,428,333 | B2 | 9/2008 | Asari et al. | |
| 9,055,227 | B2 * | 6/2015 | Batur | H04N 5/217 |
| 9,236,029 | B2 * | 1/2016 | Barnhoefer | G09G 3/3406 |
| 2004/0032982 | A1 * | 2/2004 | Nishizawa | G09G 3/2007 382/171 |

(Continued)

*Primary Examiner* — Darlene M Ritchie
(74) *Attorney, Agent, or Firm* — H.C. Park & Associates, PLC

(57) ABSTRACT

A method of performing image-adaptive tone mapping includes: determining a tone mapping curve based on a data signal corresponding to an image frame to be displayed on a display panel; determining whether a scene-change occurs between the image frame and a previous image frame by comparing the data signal with a previous data signal corresponding to the previous image frame; generating, in response to a determination that the scene-change does not occur, a final tone mapping curve based on the tone mapping curve and a previous tone mapping curve, which is applied to the previous image frame; determining, in response to a determination that the scene change occurs, the tone mapping curve as the final tone mapping curve; and performing a tone mapping by applying the final tone mapping curve to the image frame.

18 Claims, 15 Drawing Sheets

(56) References Cited

U.S. PATENT DOCUMENTS

| | | | | |
|---|---|---|---|---|
| 2005/0001935 | A1* | 1/2005 | Kiuchi | H04N 5/147 348/607 |
| 2008/0100743 | A1* | 5/2008 | Cho | G06T 5/007 348/447 |
| 2010/0013748 | A1* | 1/2010 | Cok | H04N 9/67 345/83 |
| 2010/0166301 | A1* | 7/2010 | Jeon | G06T 5/009 382/162 |
| 2011/0235720 | A1* | 9/2011 | Banterle | H04N 19/34 375/240.25 |
| 2012/0169784 | A1* | 7/2012 | Lee | G09G 3/3614 345/690 |
| 2012/0188262 | A1* | 7/2012 | Rabii | G09G 5/393 345/534 |
| 2015/0049122 | A1* | 2/2015 | Buckley | G09G 3/2003 345/690 |
| 2016/0012571 | A1* | 1/2016 | Yang | G09G 3/3406 345/694 |
| 2016/0379555 | A1* | 12/2016 | Kim | G09G 3/3291 345/691 |
| 2017/0070719 | A1 | 3/2017 | Smolic et al. | |

* cited by examiner

METHOD OF PERFORMING AN IMAGE-ADAPTIVE TONE MAPPING AND DISPLAY DEVICE EMPLOYING THE SAME

CROSS-REFERENCE TO RELATED APPLICATION

This application claims priority from and the benefit of Korean Patent Application No. 10-2018-0026541, filed Mar. 6, 2018, which is hereby incorporated by reference for all purposes as if fully set forth herein.

BACKGROUND

Field

Exemplary embodiments generally relate to display devices, an, more particularly, to a method of performing an image-adaptive tone mapping that improves a contrast ratio of an image frame by performing a tone mapping on the image frame and a display device that employs the method of performing the image-adaptive tone mapping.

Discussion

A display device can enhance image quality by improving a contrast ratio of an image frame by performing a tone mapping on the image frame. For example, the display device may perform the tone mapping on the image frame by converting an RGB signal corresponding to the image frame to be displayed via a display panel into an YCbCr signal, converting the YCbCr signal into an Y'Cb'Cr' signal based on a tone mapping curve, converting the Y'Cb'Cr' signal to an R'G'B' signal, and displaying the image frame based on the R'G'B' signal. To this end, the display device typically determines the tone mapping curve by analyzing a data signal corresponding to the image frame for respective image frames. Since data signals corresponding to image frames that implement similar images are similar to each other, it is common that similar tone mapping curves are determined for the image frames that implement similar images. However, in some cases (e.g., when a small portion that can affect overall luminance is displayed in a boundary region of the image frame, etc.), tone mapping curves with large differences may be determined for the image frames that implement the similar images. Thus, because the tone mapping is performed by applying the tone mapping curves with large differences to the image frames that implement the similar images, a luminance (or brightness) difference between the image frames on the display panel may be large, and the luminance difference may result in a flicker that can be observed (or recognized) by a user (or viewer). As a result, image quality can be rather degraded in a conventional display device employing such a tone mapping technique.

The above information disclosed in this section is only for understanding the background of the inventive concepts, and, therefore, may contain information that does not form prior art.

SUMMARY

Some exemplary embodiments provide a method of performing an image-adaptive tone mapping that is capable of preventing (or at least reducing) a flicker, which can be observed by a user (or viewer), from occurring when performing a tone mapping on an image frame to be displayed via a display panel.

Some exemplary embodiments provide a display device capable of providing a high-quality image to a user by employing a method of performing an image-adaptive tone mapping capable of preventing (or at least reducing) a flicker, which can be observed by a user (or viewer), from occurring when performing a tone mapping on an image frame to be displayed via a display panel of the display device.

Additional aspects will be set forth in the detailed description which follows, and, in part, will be apparent from the disclosure, or may be learned by practice of the inventive concepts.

According to some exemplary embodiments, a method of performing image-adaptive tone mapping includes: determining a tone mapping curve based on a data signal corresponding to an image frame to be displayed on a display panel; determining whether a scene-change occurs between the image frame and a previous image frame by comparing the data signal with a previous data signal corresponding to the previous image frame; generating, in response to a determination that the scene-change does not occur, a final tone mapping curve based on the tone mapping curve and a previous tone mapping curve, which is applied to the previous image frame; determining, in response to a determination that the scene change occurs, the tone mapping curve as the final tone mapping curve; and performing a tone mapping by applying the final tone mapping curve to the image frame.

In some exemplary embodiments, the data signal and the previous data signal may be RGB signals.

In some exemplary embodiments, determining the tone mapping curve may include: extracting a luminance signal from the data signal; determining, for the image frame based on the luminance signal, an entire-grayscale luminance average, a low-grayscale luminance average, and a high-grayscale luminance average; and determining a tone mapping function corresponding to the tone mapping curve based on the entire-grayscale luminance average, the low-grayscale luminance average, and the high-grayscale luminance average.

In some exemplary embodiments, the entire-grayscale luminance average may be determined as an average pixel-luminance of pixels included in the display panel, some of the pixels may be classified into high-grayscale luminance pixels having pixel-luminance is greater than the entire-grayscale luminance average, and some of the pixels may be classified into low-grayscale luminance pixels having pixel-luminance less than the entire-grayscale luminance average.

In some exemplary embodiments, the low-grayscale luminance average may be determined as an average pixel-luminance of the low-grayscale luminance pixels, and the high-grayscale luminance average may be determined as an average pixel-luminance of the high-grayscale luminance pixels.

In some exemplary embodiments, determining whether the scene-change occurs may include: extracting, from the data signal, a luminance signal, a blue color-difference signal, and a red color-difference signal; extracting, from the previous data signal, a previous luminance signal, a previous blue color-difference signal, and a previous red color-difference signal; determining a luminance difference between the luminance signal and the previous luminance signal, a blue color-difference difference between the blue color-difference signal and the previous blue color-difference signal, and a red color-difference difference between the red color-difference signal and the previous red color-difference signal; and determining whether the scene-change occurs based on the luminance difference, the blue color-difference difference, and the red color-difference difference.

In some exemplary embodiments, it may be determined that the scene-change does not occur in response to the luminance difference being less than a reference luminance difference, the blue color-difference difference being less than a reference blue color-difference difference, and the red color-difference difference being less than a reference red color-difference difference.

In some exemplary embodiments, it may be determined that the scene-change occurs in response to the luminance difference being greater than the reference luminance difference, the blue color-difference difference being greater than the reference blue color-difference difference, or the red color-difference difference being greater than the reference red color-difference difference.

In some exemplary embodiments, generating the final tone mapping curve may include: extracting a luminance signal from the data signal; extracting a previous luminance signal from the previous data signal; determining a luminance difference between the luminance signal and the previous luminance signal; and adding a curve-change amount corresponding to the luminance difference to the previous tone mapping curve.

In some exemplary embodiments, generating the final tone mapping curve may include: extracting a luminance signal from the data signal; extracting a previous luminance signal from the previous data signal; determining a luminance difference between the luminance signal and the previous luminance signal; adding, in response to the luminance difference being less than a first reference luminance difference, a minimum curve-change amount to the previous tone mapping curve; adding, in response to the luminance difference being greater than a second reference luminance difference that is greater than the first reference luminance difference, a maximum curve-change amount to the previous tone mapping curve; and adding, in response to the luminance difference being greater than the first reference luminance difference and less than the second reference luminance difference, a curve-change amount corresponding to the luminance difference to the previous tone mapping curve.

In some exemplary embodiments, the curve-change amount may be determined by performing an interpolation between the minimum curve-change amount and the maximum curve-change amount.

In some exemplary embodiments, generating the final tone mapping curve may include: determining a first curve type of the previous tone mapping curve; determining a second curve type of the tone mapping curve; determining whether the first curve type is the same as the second curve type; and generating, in response to the first curve type being different from the second curve type, the final tone mapping curve to have a linear shape.

In some exemplary embodiments, the first curve type may be determined as an S-shape curve type and the second curve type may be determined as a C-shape curve type.

In some exemplary embodiments, the first curve type may be determined as a C-shape curve type and the second curve type may be determined as an S-shape curve type.

According to some exemplary embodiments, a display device includes a display panel including pixels, and a display panel driving circuit configured to drive the display panel. The display panel driving circuit is configured to: determine a tone mapping curve based on a data signal corresponding to an image frame to be displayed on the display panel; determine whether a scene-change occurs between the image frame and a previous image frame based on a comparison of the data signal with a previous data signal corresponding to the previous image frame; generate, in response to a determination that the scene-change does not occur, a final tone mapping curve based on the tone mapping curve and a previous tone mapping curve, which is applied to the previous image frame; determine, in response to a determination that the scene-change occurs, the tone mapping curve as the final tone mapping curve; and perform a tone mapping via application of the final tone mapping curve to the image frame.

In some exemplary embodiments, the display panel driving circuit may be configured to determine the tone mapping curve at least via: extraction of a luminance signal from the data signal; a determination, for the image frame based on the luminance signal, of an entire-grayscale luminance average, a low-grayscale luminance average, and a high-grayscale luminance average; and a determination of a tone mapping function corresponding to the tone mapping curve based on the entire-grayscale luminance average, the low-grayscale luminance average, and the high-grayscale luminance average.

In some exemplary embodiments, the display panel driving circuit may be configured to determine whether a scene change occurs at least via: extraction, from the data signal, of a luminance signal, a blue color-difference signal, and a red color-difference signal; extraction, from the previous data signal, of a previous luminance signal, a previous blue color-difference signal, and a previous red color-difference signal; a determination of a luminance difference between the luminance signal and the previous luminance signal, a blue color-difference difference between the blue color-difference signal and the previous blue color-difference signal, and a red color-difference difference between the red color-difference signal and the previous red color-difference signal; a determination of whether the scene-change occurs based on the luminance difference, the blue color-difference difference, and the red color-difference difference.

In some exemplary embodiments, the display panel driving circuit may be configured to generate the final tone mapping curve at least via: extraction of a luminance signal from the data signal; extraction of a previous luminance signal from the previous data signal; a determination of a luminance difference between the luminance signal and the previous luminance signal; and addition of a curve-change amount corresponding to the luminance difference to the previous tone mapping curve.

In some exemplary embodiments, the display panel driving circuit may be configured to generate the final tone mapping curve at least via: extraction of a luminance signal from the data signal; extraction of a previous luminance signal from the previous data signal; a determination of a luminance difference between the luminance signal and the previous luminance signal; addition, in response to the luminance difference being less than a first reference luminance difference, of a minimum curve-change amount to the previous tone mapping curve; addition, in response to the luminance difference being greater than a second reference luminance difference that is greater than the first reference luminance difference, of a maximum curve-change amount to the previous tone mapping curve; and addition, in response to the luminance difference being greater than the first reference luminance difference and less than the second reference luminance difference, of a curve-change amount corresponding to the luminance difference to the previous tone mapping curve.

In some exemplary embodiments, the display panel driving circuit may be configured to: determine a first curve type of the previous tone mapping curve; determine a second curve type of the tone mapping curve; determine whether the first curve type is the same as the second curve type; and generate, in response to the first curve type being different from the second curve type, the final tone mapping curve to have a linear shape.

According to various exemplary embodiments, a method of performing an image-adaptive tone mapping may prevent (or at least reduce) a flicker that a user (or viewer) can observe from occurring when performing a tone mapping on an image frame to be displayed on a display panel by calculating, determining, or obtaining a tone mapping curve based on a data signal corresponding to an image frame to be displayed on a display panel, determining whether a scene-change occurs between the image frame and a previous image frame by comparing the data signal corresponding to the image frame with a previous data signal corresponding to the previous image frame, generating a final tone mapping curve based on the tone mapping curve that determined based on the data signal corresponding to the image frame and a previous tone mapping curve that is applied to the previous image frame when it is determined that the scene-change does not occur between the image frame and the previous image frame, determining the tone mapping curve that is calculated based on the data signal corresponding to the image frame as the final tone mapping curve when it is determined that the scene-change occurs between the image frame and the previous image frame, and performing a tone mapping by applying the final tone mapping curve to the image frame. Thus, the method of performing the image-adaptive tone mapping may effectively improve a contrast ratio of the image frame without flicker(s). In addition, a display device employing the method of performing the image-adaptive tone mapping according to various exemplary embodiments may provide a high-quality image to a user.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION OF THE ILLUSTRATED EMBODIMENTS

Figure 1:
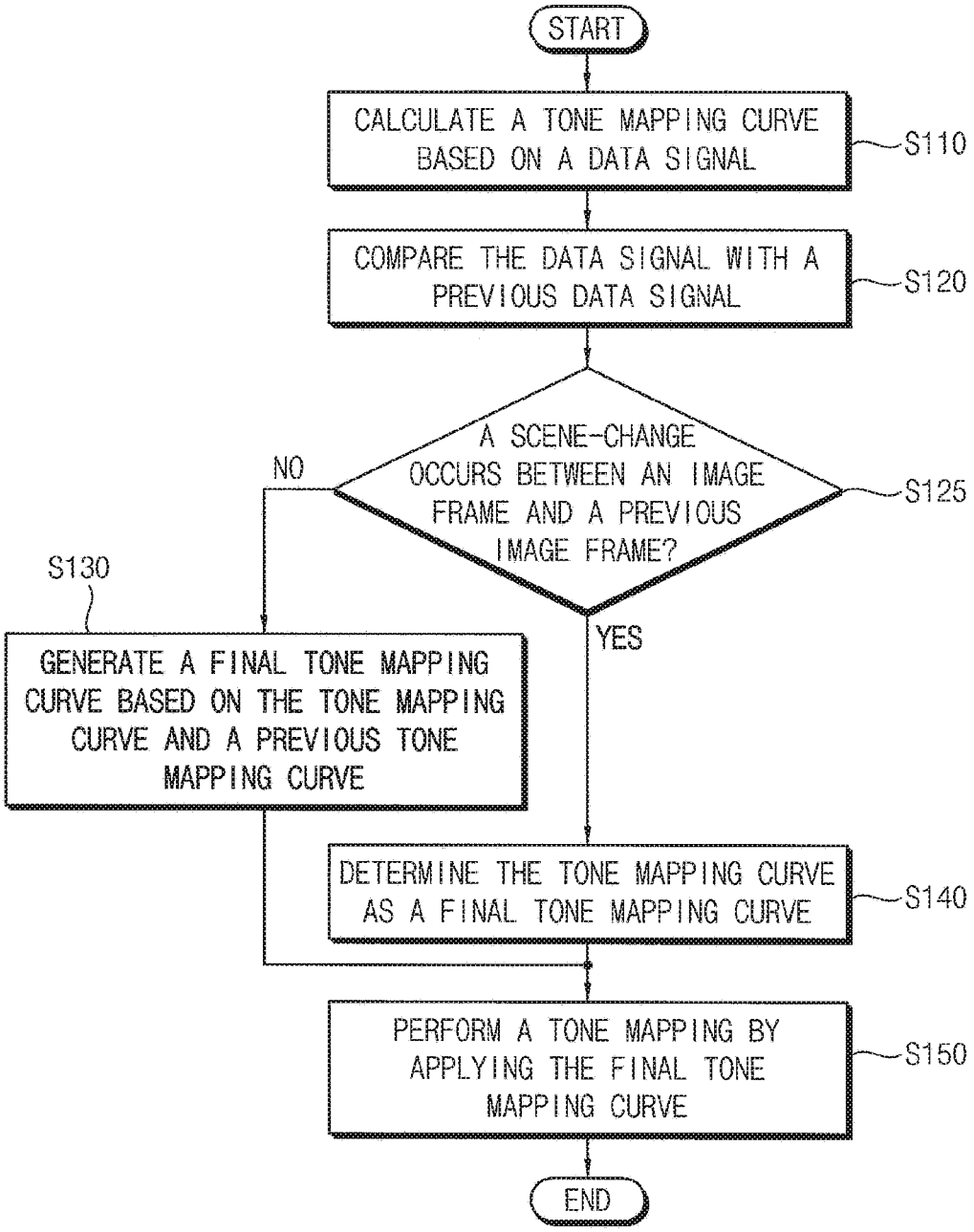
FIG. 1 is a flowchart illustrating a method of performing an image-adaptive tone mapping according to some exemplary embodiments.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some exemplary embodiments. Therefore, unless otherwise specified, the features, components, modules, layers, films, panels, regions, aspects, etc. (hereinafter individually or collectively referred to as an "element" or "elements"), of the various illustrations may be otherwise combined, separated, interchanged, and/or rearranged without departing from the inventive concepts.

In the accompanying drawings, the size and relative sizes of elements may be exaggerated for clarity and/or descriptive purposes. As such, the sizes and relative sizes of the respective elements are not necessarily limited to the sizes and relative sizes shown in the drawings. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. Other terms and/or phrases used to describe a relationship between elements should be interpreted in a like fashion, e.g., "between" versus "directly between," "adjacent" versus "directly adjacent," "on" versus "directly on," etc. Further, the term "connected" may refer to physical, electrical, and/or fluid connection. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one element's relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to cross-sectional views, isometric views, perspective views, plan views, and/or exploded illustrations that are schematic illustrations of idealized exemplary embodiments and/or intermediate structures. As such, variations from the shapes of the illustrations as a result of, for example, manufacturing techniques and/or tolerances, are to be expected. Thus, exemplary embodiments disclosed herein should not be construed as limited to the particular illustrated shapes of regions, but are to include deviations in shapes that result from, for instance, manufacturing. To this end, regions illustrated in the drawings may be schematic in nature and shapes of these regions may not reflect the actual shapes of regions of a device, and, as such, are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

As customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the inventive concepts. Further, the blocks, units, and/or modules of some exemplary embodiments may be physically combined into more complex blocks, units, and/or modules without departing from the inventive concepts.

Hereinafter, various exemplary embodiments will be explained in detail with reference to the accompanying drawings.

Figure 2A:
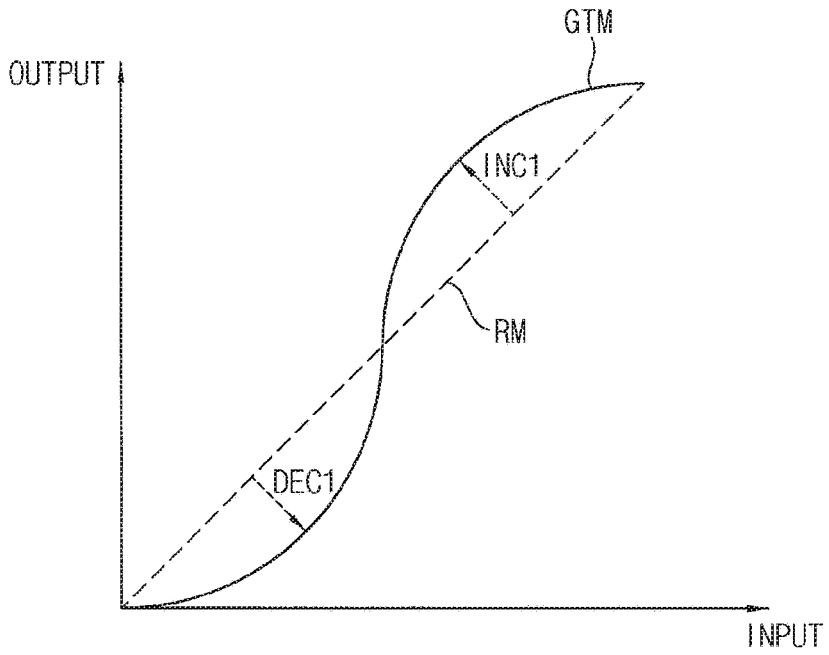
FIG. 2A is a diagram illustrating an example of a tone mapping curve determined by the method of FIG. 1 according to some exemplary embodiments.
Figure 2B:
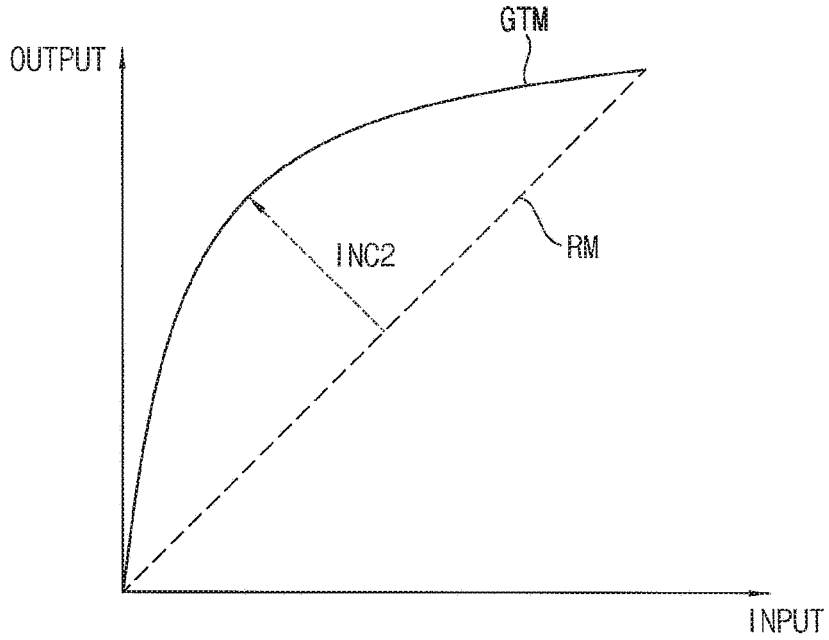
FIG. 2B is a diagram illustrating another example of a tone mapping curve determined by the method of FIG. 1 according to some exemplary embodiments.
Figure 3:
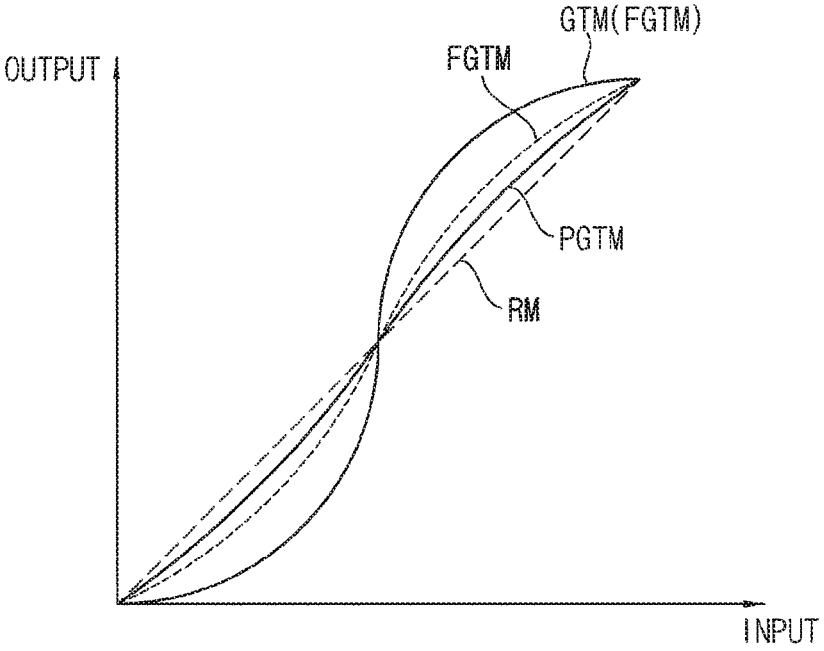
FIG. 3 is a diagram for describing the method of FIG. 1 according to some exemplary embodiments.

FIG. 1 is a flowchart illustrating a method of performing an image-adaptive tone mapping according to some exemplary embodiments. FIG. 2A is a diagram illustrating an example of a tone mapping curve determined by the method of FIG. 1 according to some exemplary embodiments. FIG. 2B is a diagram illustrating another example of a tone mapping curve determined by the method of FIG. 1 according to some exemplary embodiments. FIG. 3 is a diagram for describing the method of FIG. 1 according to some exemplary embodiments.

Referring to FIGS. 1 to 3, the method of FIG. 1 may calculate, determine, or obtain (hereinafter, collectively or individually referred to as "calculate") a tone mapping curve GTM based on a data signal corresponding to an image frame (e.g., a current image frame) to be displayed on a display panel (S110); may compare the data signal corresponding to the image frame with a previous data signal corresponding to a previous image frame (S120) to determine whether a scene-change occurs between the image frame and the previous image frame (S125); may generate a final tone mapping curve FGTM based on the tone mapping curve GTM, which is calculated based on the data signal corresponding to the image frame and a previous tone mapping curve PGTM, which is applied to the previous image frame (S130) when it is determined that the scene-change does not occur between the image frame and the previous image frame; may determine the tone mapping curve GTM, which is calculated based on the data signal corresponding to the image frame, as the final tone mapping curve FGTM (S140) when it is determined (or in response to a determination) that the scene-change occurs between the image frame and the previous image frame; and may perform a tone mapping by applying the final tone mapping curve FGTM to the image frame to be displayed on the display panel (S150). Here, the method of FIG. 1 may perform the steps S110, S120, S125, S130, S140, and S150 for respective image frames to be displayed on the display panel. In some exemplary embodiments, the data signal for implementing the image frame and the previous data signal for implementing the previous image frame may be RGB signals.

According to various exemplary embodiments, the method of FIG. 1 may calculate the tone mapping curve GTM based on the data signal corresponding to the image frame to be displayed on the display panel (S110). That is, the method of FIG. 1 may obtain the tone mapping curve GTM by analyzing the data signal corresponding to the image frame. In some exemplary embodiments, the method of FIG. 1 may calculate the tone mapping curve GTM by extracting a luminance signal from the data signal corresponding to the image frame; calculating an entire-grayscale luminance average, a low-grayscale luminance average, and a high-grayscale luminance average of the image frame based on the luminance signal, which is extracted from the data signal; and calculating a tone mapping function corresponding to the tone mapping curve GTM based on the entire-grayscale luminance average, the low-grayscale luminance average, and the high-grayscale luminance average of the image frame.

For instance, the method of FIG. 1 may extract the luminance signal from the data signal corresponding to the image frame. In some exemplary embodiments, when the data signal corresponding to the image frame is an RGB signal, the method of FIG. 1 may convert the RGB signal into an YCbCr signal and may extract the luminance signal (e.g., a Y signal) from the YCbCr signal. Subsequently, the method of FIG. 1 may calculate the entire-grayscale luminance average, the low-grayscale luminance average, and the high-grayscale luminance average of the image frame based on the luminance signal that is extracted from the data signal.

In some exemplary embodiments, the method of FIG. 1 may calculate the entire-grayscale luminance average of the image frame as an average of pixel-luminance (e.g., luminance that each pixel is to implement in the image frame) of all pixels included in the display panel. Here, the method of FIG. 1 may classify the pixels included in the display panel into high-grayscale luminance pixels of which the pixel-luminance is greater than the entire-grayscale luminance average of the image frame and low-grayscale luminance pixels of which the pixel-luminance is less than the entire-grayscale luminance average of the image frame. In exemplary embodiments, the method of FIG. 1 may classify the pixels of which the pixel-luminance is equal to the entire-grayscale luminance average of the image frame into the high-grayscale luminance pixels or the low-grayscale luminance pixels according to given (or predetermined) requirements. In some exemplary embodiments, the method of FIG. 1 may calculate the low-grayscale luminance average of the image frame as an average of the pixel-luminance of the low-grayscale luminance pixels among the pixels included in the display panel and may calculate the high-grayscale luminance average of the image frame as an average of the pixel-luminance of the high-grayscale luminance pixels among the pixels included in the display panel.

The method of FIG. 1 may obtain the tone mapping curve GTM by calculating the tone mapping function based on the entire-grayscale luminance average, the low-grayscale luminance average, and the high-grayscale luminance average of the image frame. In some exemplary embodiments, the tone mapping curve GTM may have an S-shape curve type, a linear line type, or a C-shape curve type. In some exemplary embodiments, the tone mapping curve GTM may have an inverse S-shape curve type or an inverse C-shape curve type. However, it may be undesirable for the tone mapping curve GTM to have the inverse S-shape curve type or the inverse C-shape curve type because a tone-mapped image quality may often be worse than an original image quality.

According to some exemplary embodiments, as illustrated in FIGS. 2A and 2B, the method of FIG. 1 may derive the tone mapping curve GTM using (or with respect to) a reference function RM. Here, the reference function RM denotes a function when the tone mapping is not performed. For example, as illustrated in FIG. 2A, the tone mapping curve GTM may have the S-shape curve type. When a median value between predetermined maximum luminance and the entire-grayscale luminance average of the image frame is greater than the high-grayscale luminance average of the image frame, the method of FIG. 1 may derive the tone mapping curve GTM by moving the tone mapping curve GTM upwardly over the reference function RM in a high-grayscale section, which is indicated by INC1. In addition, when a median value between predetermined minimum luminance and the entire-grayscale luminance average of the image frame is less than the low-grayscale luminance average of the image frame, the method of FIG. 1 may derive the tone mapping curve GTM by moving the tone mapping curve GTM downwardly under the reference function RM in a low-grayscale section, which is indicated by DEC1. For example, as illustrated in FIG. 2B, the tone mapping curve GTM may have the C-shape curve type. When the median value between the predetermined maximum luminance and the entire-grayscale luminance average of the image frame is greater than the high-grayscale luminance average of the image frame and when the median value between the predetermined minimum luminance and the entire-grayscale luminance average of the image frame is greater than the low-grayscale luminance average of the image frame, the method of FIG. 1 may derive the tone mapping curve GTM by moving the tone mapping curve GTM upwardly over the reference function RM in an entire-grayscale section, which is indicated by INC2. However, deriving the tone mapping curve GTM is not limited thereto.

Next, the method of FIG. 1 may determine whether the scene-change occurs between the image frame and the previous image frame (S125) by comparing the data signal corresponding to the image frame with the previous data signal corresponding to the previous image frame (S120). In some exemplary embodiments, when the data signal corresponding to the image frame is the RGB signal, the method of FIG. 1 may convert the RGB signal into the YCbCr signal and may extract the luminance signal (e.g., a Y signal), the blue color-difference signal (e.g., a Cb signal), and the red color-difference signal (e.g., a Cr signal) from the YCbCr signal. In this case, the method of FIG. 1 may extract the luminance signal, the blue color-difference signal, and the red color-difference signal from the data signal corresponding to the image frame; may extract a previous luminance signal, a previous blue color-difference signal, and a previous red color-difference signal from the previous data signal corresponding to the previous image frame; may calculate a luminance difference between the luminance signal and the previous luminance signal, a blue color-difference difference between the blue color-difference signal and the previous blue color-difference signal, and a red color-difference difference between the red color-difference signal and the previous red color-difference signal; and may determine whether the scene-change occurs between the image frame and the previous image frame based on the luminance difference, the blue color-difference difference, and the red color-difference difference.

The method of FIG. 1 may determine that the scene-change does not occur between the image frame and the previous image frame when the luminance difference is less than a reference luminance difference, when the blue color-difference difference is less than a reference blue color-difference difference, and when the red color-difference difference is less than a reference red color-difference difference. On the other hand, the method of FIG. 1 may determine that the scene-change occurs between the image frame and the previous image frame when the luminance difference is greater than the reference luminance difference, when the blue color-difference difference is greater than the reference blue color-difference difference, or when the red color-difference difference is greater than the reference red color-difference difference.

When it is determined that the scene-change does not occur between the image frame and the previous image frame, the method of FIG. 1 may generate the final tone mapping curve FGTM based on the tone mapping curve GTM, which is calculated based on the data signal corresponding to the image frame and the previous tone mapping curve PGTM, which is applied to the previous image frame (S130). In some exemplary embodiments, the method of FIG. 1 may generate the final tone mapping curve FGTM by extracting the luminance signal from the data signal corresponding to the image frame, extracting the previous luminance signal from the previous data signal corresponding to the previous image frame, calculating the luminance difference between the luminance signal and the previous luminance signal, and adding a curve-change amount corresponding to the luminance difference to the previous tone mapping curve PGTM toward the tone mapping curve GTM, which is calculated based on the data signal corresponding to the image frame.

In some exemplary embodiments, the method of FIG. 1 may generate the final tone mapping curve FGTM by extracting the luminance signal from the data signal corresponding to the image frame; extracting the previous luminance signal from the previous data signal corresponding to the previous image frame; calculating the luminance difference between the luminance signal and the previous luminance signal; adding a minimum curve-change amount to the previous tone mapping curve PGTM toward the tone mapping curve GTM, which is calculated based on the data signal corresponding to the image frame when the luminance difference is less than a first reference luminance difference; adding a maximum curve-change amount to the previous tone mapping curve PGTM toward the tone mapping curve GTM, which is calculated based on the data signal corresponding to the image frame when the luminance difference is greater than a second reference luminance difference that is greater than the first reference luminance difference; and adding a curve-change amount corresponding to the luminance difference to the previous tone mapping curve PGTM toward the tone mapping curve GTM. which is calculated based on the data signal corresponding to the image frame when the luminance difference is greater than the first reference luminance difference and less than the second reference luminance difference.

The curve-change amount may be calculated by performing an interpolation (e.g., a linear interpolation, a non-linear interpolation, etc.) between the minimum curve-change amount and the maximum curve-change amount. As a result, as illustrated in FIG. 3, when it is determined that the scene-change does not occur between the image frame and the previous image frame, an optimal tone mapping curve that reflects an amount of image frame variation between the tone mapping curve GTM and the previous tone mapping curve PGTM may be determined as the final tone mapping curve FGTM. In other words, when it is determined that the scene-change does not occur between the image frame and the previous image frame, the tone mapping curve GTM, which is calculated based on the data signal corresponding to the image frame, may not be determined directly as the final tone mapping curve FGTM.

As described above, because the tone mapping curve GTM is determined by analyzing the data signal corresponding to the image frame and because the data signals corresponding to the image frames that implement similar images are similar to each other, it is common that similar tone mapping curves GTM are determined (or set) for the image frames that implement the similar images. For example, however, when a small portion that can affect overall luminance is displayed in a boundary region of the image frame, the tone mapping curves GTM with large differences may be determined for the image frames that implement the similar images. In this case, although remaining portions of the image frame other than the small portion should be implemented with luminance similar to that of the previous image frame, a relatively large luminance (or brightness) difference may be caused, between the image frame and the previous image frame, in the remaining portions of the image frame other than the small portion if respective tone mapping curves GTM with large difference due to the small portion are applied to the image frame and the previous image frame, respectively. The luminance difference may result in a flicker that a user can observe such that an image quality may be degraded. Thus, when it is determined that the scene-change does not occur between the image frame and the previous image frame, the method of FIG. 1 may not determine the tone mapping curve GTM that is calculated based on the data signal corresponding to the image frame as the final tone mapping curve FGTM. That is, the method of FIG. 1 may determine the optimal tone mapping curve that reflects the amount of the image frame variation between the tone mapping curve GTM and the previous tone mapping curve PGTM as the final tone mapping curve FGTM. Thus, the method of FIG. 1 may gradually (or gently) change luminance between the image frames that implement the similar images by reflecting information relating to the image frame (e.g., current image frame) and the previous image frame even when the tone mapping curves GTM with large differences are calculated for the image frames that implement the similar images. As a result, the method of FIG. 1 may prevent (or at least reduce) the flicker that the user can observe from occurring when performing a tone mapping on the image frame to be displayed on the display panel. In brief, exemplary embodiments may be referred to as an image-adaptive temporal filtering processing technique. In addition, the curve-change amount may be referred to as a temporal filtering change amount.

In some exemplary embodiments, the method of FIG. 1 may check a first curve type of the previous tone mapping curve PGTM; may check a second curve type of the tone mapping curve GTM, which is calculated based on the data signal corresponding to the image frame; may check whether the first curve type of the previous tone mapping curve PGTM is the same as the second curve type of the tone mapping curve GTM; may generate the final tone mapping curve FGTM to be applied to the image frame by adding the curve-change amount to the previous tone mapping curve PGTM toward the tone mapping curve GTM when the first curve type of the previous tone mapping curve PGTM is the same as the second curve type of the tone mapping curve GTM; and may generate the final tone mapping curve FGTM to be applied to the image frame to have a linear shape when the first curve type of the previous tone mapping curve PGTM is different from the second curve type of the tone mapping curve GTM.

In some exemplary embodiments, the first curve type of the previous tone mapping curve PGTM may be an S-shape curve type, and the second curve type of the tone mapping curve GTM may be a C-shape curve type. In some exemplary embodiments, the first curve type of the previous tone mapping curve PGTM may be a C-shape curve type, and the second curve type of the tone mapping curve GTM may be an S-shape curve type. Generally, when a difference between the previous tone mapping curve PGTM and the tone mapping curve GTM that is calculated based on the data signal corresponding to the image frame is relatively large, the flicker that the user can observe may occur because the curve-change amount is relatively large if the final tone mapping curve FGTM to be applied to the image frame is generated by adding the curve-change amount to the previous tone mapping curve PGTM toward the tone mapping curve GTM. Thus, the method of FIG. 1 may generate the final tone mapping curve FGTM to be applied to the image frame to have the linear shape as an intermediate process. As a result, the method of FIG. 1 may prevent (or minimize, reduce, etc.) the flicker that the user can observe from occurring. Generally, consecutive image frames are likely to implement the similar images. Thus, when the scene-change occurs between the previous image frame and the current image frame, a probability (or possibility) that a next image frame implements an image similar to that of the current image frame may be high. Hence, the method of FIG. 1 may generate a next final tone mapping curve to be applied to a next image frame by adding the curve-change amount to the current tone mapping curve toward the calculated tone mapping curve when performing a tone mapping on the next image frame.

On the other hand, when it is determined that the scene-change occurs between the image frame and the previous image frame, the method of FIG. 1 may determine the tone mapping curve GTM that is calculated based on the data signal corresponding to the image frame as the final tone mapping curve FGTM (S140). In other words, when a scene that the image frame implements is quite different from a previous scene that the previous image frame implements as the scene-change occurs between the image frame and the previous image frame, the user cannot recognize a luminance-change due to a difference between the tone mapping curve GTM to be applied to the image frame and the previous tone mapping curve PGTM applied to the previous image frame although the difference is significantly large. Thus, the method of FIG. 1 may directly apply (or reflect) the tone mapping curve GTM that is calculated based on the data signal corresponding to the image frame to the image frame regardless of the previous image frame. That is, the method of FIG. 1 may determine the tone mapping curve GTM that is calculated based on the data signal corresponding to the image frame as the final tone mapping curve FGTM.

Subsequently, the method of FIG. 1 may perform the tone mapping by applying is the final tone mapping curve FGTM that is determined in the step S130 or in the step S140 to the image frame to be displayed on the display panel. For example, as illustrated in FIG. 3, the method of FIG. 1 may perform the tone mapping on the image frame by outputting an output luminance signal OUTPUT (e.g., a tone-mapped signal) corresponding to the luminance signal INPUT that is extracted from the data signal using the final tone mapping curve FGTM. In some exemplary embodiments, the method of FIG. 1 may perform the tone mapping on the image frame by converting the data signal (e.g., the RGB signal) into the YCbCr signal, converting the luminance signal INPUT (e.g., the Y signal) of the YCbCr signal into the output luminance signal OUTPUT (e.g., the Y' signal) using the final tone mapping curve FGTM (e.g., the YCbCr signal is converted into the Y'Cb'Cr' signal), converting the Y'Cb'Cr' signal into the R'G'B' signal, and displaying the image frame based on the R'G'B' signal.

As described above, the method of FIG. 1 may prevent the flicker that the user can observe from occurring when performing the tone mapping on the image frame to be displayed on the display panel by calculating (or obtaining) the tone mapping curve GTM based on the data signal corresponding to the image frame to be displayed on the display panel by determining whether the scene-change occurs between the image frame and the previous image frame by comparing the data signal corresponding to the image frame with the previous data signal corresponding to the previous image frame, generating the final tone mapping curve FGTM based on the tone mapping curve GTM that is calculated based on the data signal corresponding to the image frame and the previous tone mapping curve PGTM that is applied to the previous image frame when it is determined that the scene-change does not occur between the image frame and the previous image frame, determining the tone mapping curve GTM that is calculated based on the data signal corresponding to the image frame as the final tone mapping curve FGTM when it is determined that the scene-change occurs between the image frame and the previous image frame, and performing the tone mapping by applying the final tone mapping curve FGTM to the image frame. Thus, the method of FIG. 1 may effectively improve a contrast ratio of the image frame without flicker(s). As a result, the method of FIG. 1 may provide a high-quality image to the user.

Figure 4:
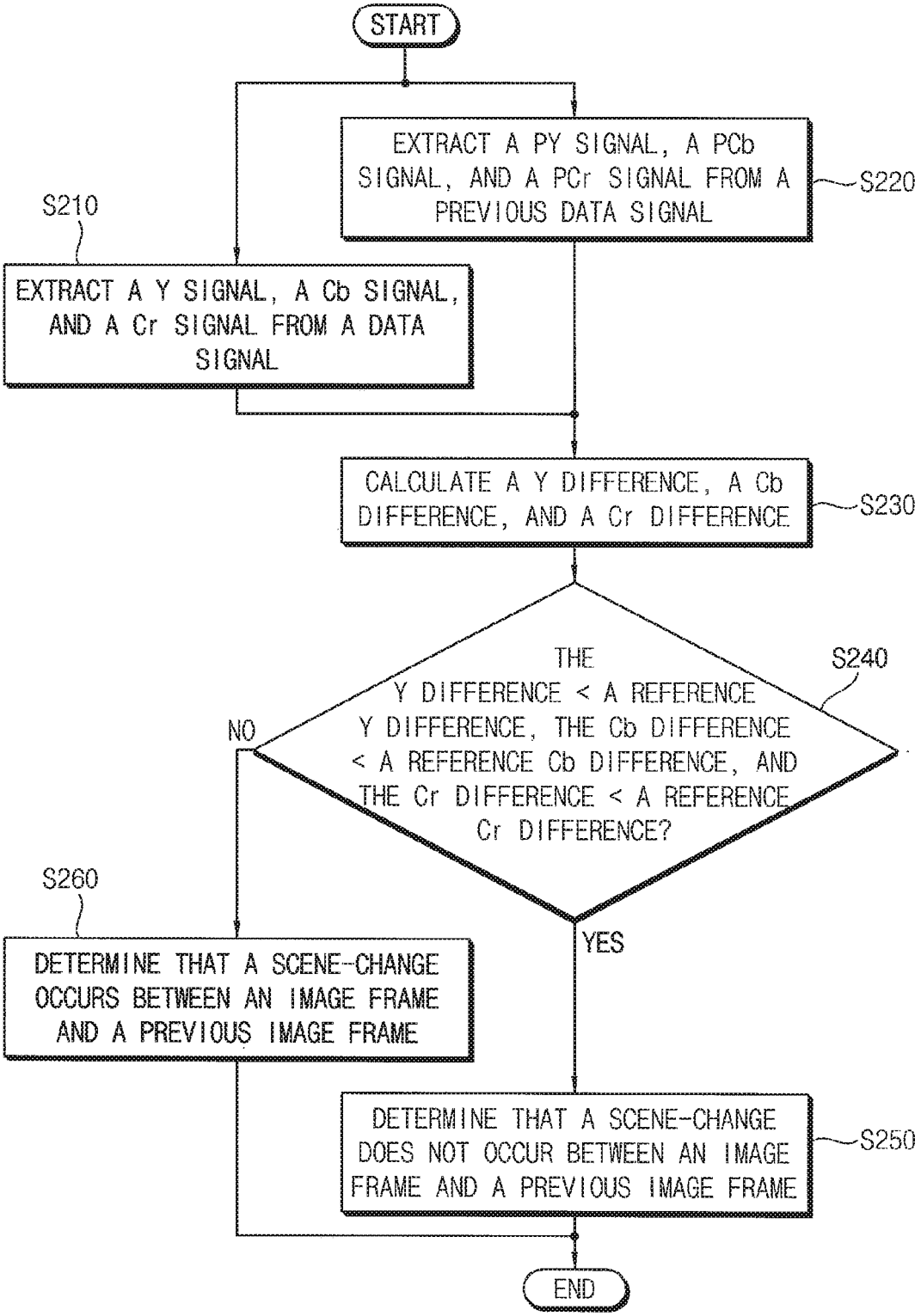
FIG. 4 is a flowchart illustrating a process in which the method of FIG. 1 applies a final tone mapping curve to an image frame according to some exemplary embodiments.

FIG. 4 is a flowchart illustrating a process in which the method of FIG. 1 applies a final tone mapping curve to an image frame according to some exemplary embodiments.

Referring to FIG. 4, the method of FIG. 1 may determine whether the scene-change occurs between the image frame and the previous image frame by comparing the data signal corresponding to the image frame with the previous data signal corresponding to the previous image frame. For instance, the method of FIG. 1 may extract the luminance signal, the blue color-difference signal, and the red color-difference signal from the data signal corresponding to the image frame (e.g., current image frame) (S210) and may extract the previous luminance signal, the previous blue color-difference signal, and the previous red color-difference signal from the previous data signal corresponding to the previous data frame (S220). Subsequently, the method of FIG. 1 may calculate the luminance difference between the luminance signal and the previous luminance signal, the blue color-difference difference between the blue color-difference signal and the previous blue color-difference signal, and the red color-difference difference between the red color-difference signal and the previous red color-difference signal (S230).

Next, the method of FIG. 1 may check whether the luminance difference is less than the reference luminance difference, whether the blue color-difference difference is less than the reference blue color-difference difference, and whether the red color-difference difference is less than the reference red color-difference difference (S240). Here, when the luminance difference is less than the reference luminance difference, when the blue color-difference difference is less than the reference blue color-difference difference, and when the red color-difference difference is less than the reference red color-difference difference, the method of FIG. 1 may determine that the scene-change does not occur between the image frame and the previous image frame (S250). In other words, when the luminance difference is less than the reference luminance difference, when the blue color-difference difference is less than the reference blue color-difference difference, and when the red color-difference difference is less than the reference red color-difference difference, the method of FIG. 1 may determine that there is no significant difference between the image frame and the previous image frame. Thus, the method of FIG. 1 may determine that the image frame implements an image that is similar to that of the previous image frame, and thus, may generate the final tone mapping curve FGTM based on the previous tone mapping curve PGTM that is applied to the previous image frame and the tone mapping curve GTM that is calculated based on the data signal corresponding to the image frame.

When, however, the luminance difference is greater than the reference luminance difference, the blue color-difference difference is greater than the reference blue color-difference difference, or the red color-difference difference is greater than the reference red color-difference difference, the method of FIG. 1 may determine that the scene-change occurs between the image frame and the previous image frame (S260). In other words, when the luminance difference is greater than the reference luminance difference, the blue color-difference difference is greater than the reference blue color-difference difference, or the red color-difference difference is greater than the reference red color-difference difference, the method of FIG. 1 may determine that there is at least one significant difference in terms of the luminance signal, the blue color-difference signal, and the red color-difference signal between the image frame and the previous image frame. Thus, the method of FIG. 1 may determine that the image frame implements an image that is not similar to that of the previous image frame, and thus, may determine the tone mapping curve GTM that is calculated based on the data signal corresponding to the image frame as the final tone mapping curve FGTM.

Figure 5:
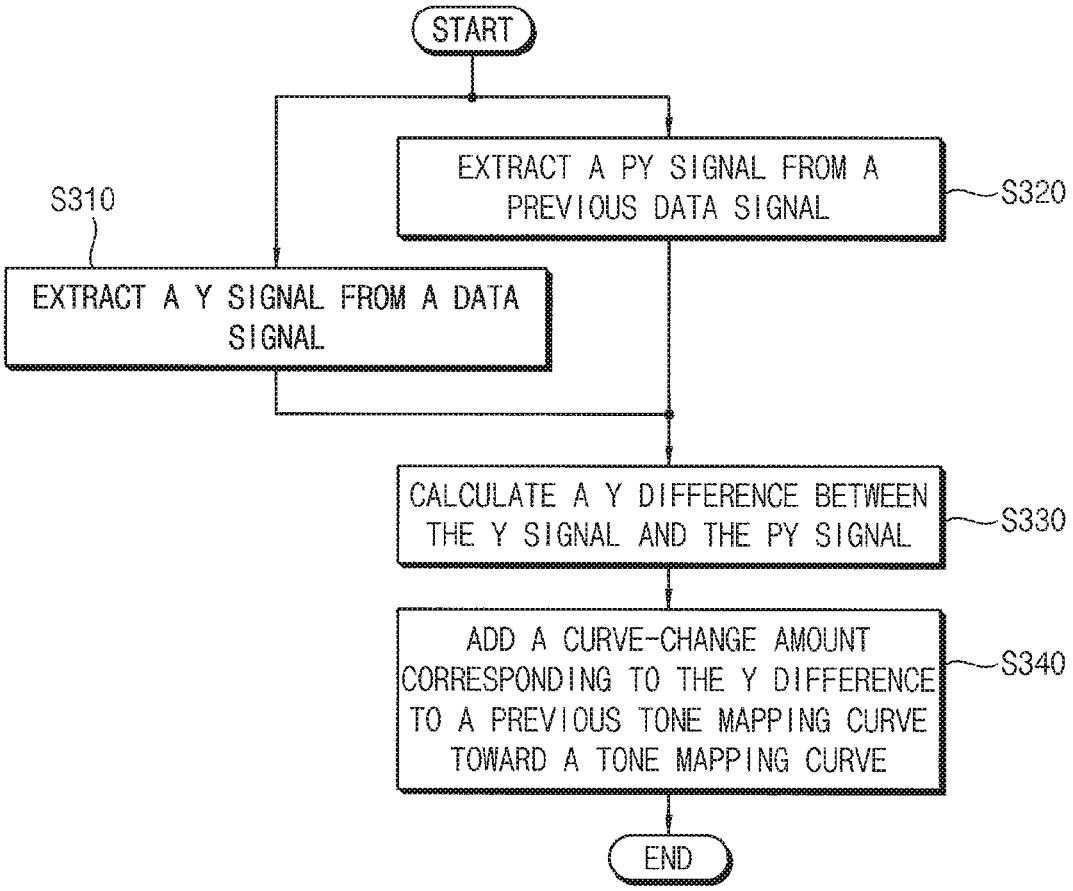
FIG. 5 is a flowchart illustrating an example in which the method of FIG. 1 generates a final tone mapping curve according to some exemplary embodiments.
Figure 6:
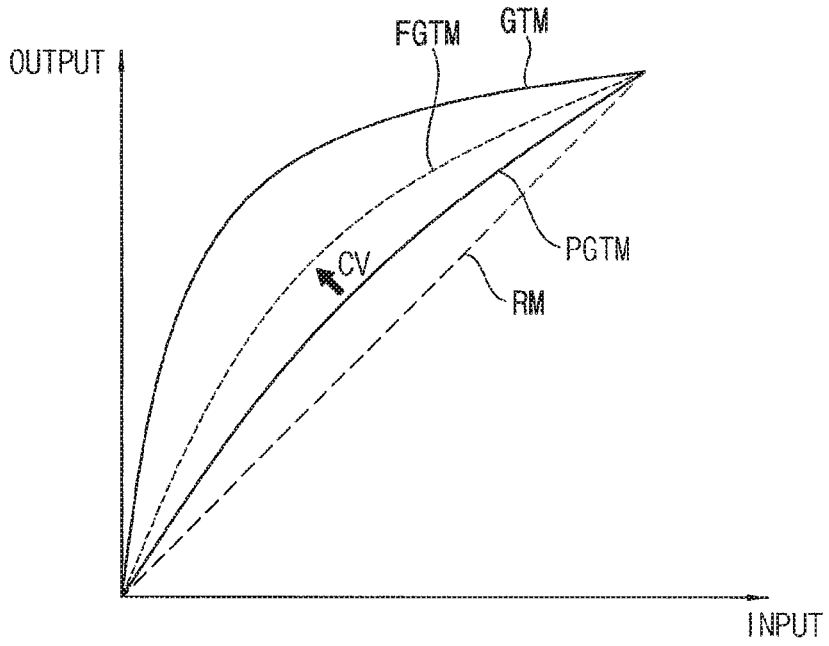
FIG. 6 is a diagram for describing an example in which the method of FIG. 1 generates a final tone mapping curve according to some exemplary embodiments.

FIG. 5 is a flowchart illustrating an example in which the method of FIG. 1 generates a final tone mapping curve according to some exemplary embodiments. FIG. 6 is a diagram for describing an example in which the method of FIG. 1 generates a final tone mapping curve according to some exemplary embodiments.

Referring to FIGS. 5 and 6, the method of FIG. 1 may generate the final tone mapping curve FGTM based on the previous tome mapping curve PGTM that is applied to the previous image frame and the tone mapping curve GTM that is calculated based on the data signal corresponding to the image frame when it is determined that the scene-change does not occur between the image frame and the previous image frame. For instance, the method of FIG. 1 may extract the luminance signal from the data signal corresponding to the image frame (S310), may extract the previous luminance signal from the previous data signal corresponding to the previous image frame (S320), and may calculate the luminance difference between the luminance signal and the previous luminance signal (S330). Subsequently, the method of FIG. 1 may generate the final tone mapping curve FGTM by adding the curve-change amount CV corresponding to the luminance difference to the previous tone mapping curve PGTM toward the tone mapping curve GTM that is calculated based on the data signal corresponding to the image frame (S340).

For example, as illustrated in FIG. 6, the method of FIG. 1 may calculate (or obtain) the tone mapping curve GTM using the reference function RM based on the data signal corresponding to the image frame. If the tone mapping is performed by determining the tone mapping curve GTM that is calculated based on the data signal corresponding to the image frame as the final tone mapping curve FGTM even when the scene-change does not occur between the image frame and the previous image frame, in some cases, the flicker that the user can observe may occur because the tone mapping curves GTM and PGTM with large differences are applied to the respective image frames that implement the similar images. Thus, the method of FIG. 1 may prevent the tone mapping curves GTM and PGTM with large differences from being applied to the respective image frames that implement the similar images by generating the final tone mapping curve FGTM by adding the curve-change amount CV corresponding to the luminance difference to the previous tone mapping curve PGTM toward the tone mapping curve GTM that is calculated based on the data signal corresponding to the image frame. As a result, the method of FIG. 1 may prevent (or minimize) the flicker that the user can observe from occurring. For convenience of description, although it is illustrated in FIG. 6 that the tone mapping curve GTM, the previous tone mapping curve PGTM, and the final tone mapping curve FGTM have the C-shape curve type, exemplary embodiments are not limited thereto. For example, the tone mapping curve GTM, the previous tone mapping curve PGTM, and the final tone mapping curve FGTM may have various curve types (e.g., the S-shape curve type, etc.).

Figure 7:
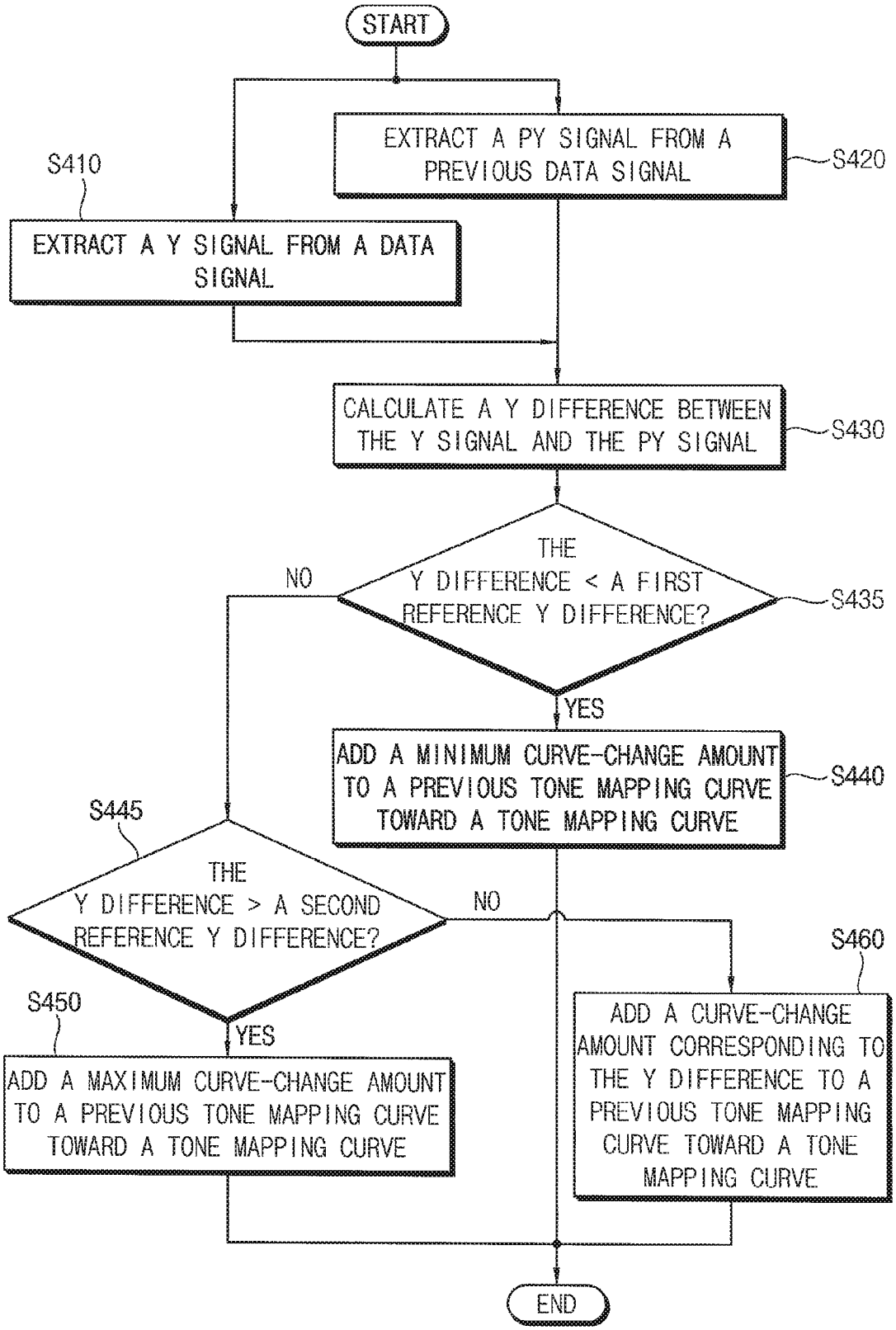
FIG. 7 is a flowchart illustrating another example in which the method of FIG. 1 generates a final tone mapping curve according to some exemplary embodiments.
Figure 8:
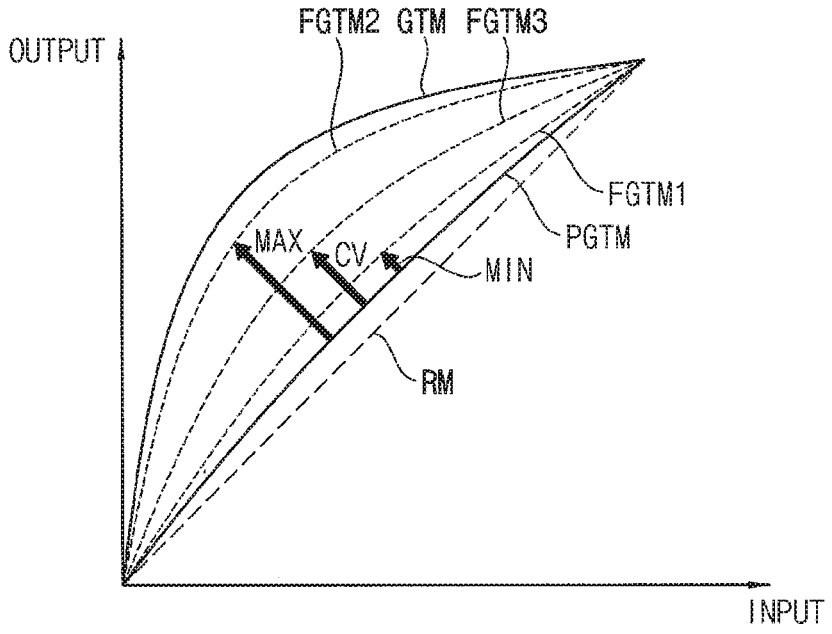
FIG. 8 is a diagram for describing another example in which the method of FIG. 1 generates a final tone mapping curve according to some exemplary embodiments.

FIG. 7 is a flowchart illustrating another example in which the method of FIG. 1 generates a final tone mapping curve according to some exemplary embodiments. FIG. 8 is a diagram for describing another example in which the method of FIG. 1 generates a final tone mapping curve according to some exemplary embodiments.

Referring to FIGS. 7 and 8, the method of FIG. 1 may generate the final tone mapping curve FGTM1, FGTM2, and FGTM3 based on the previous tone mapping curve PGTM that is applied to the previous image frame and the tone mapping curve GTM that is calculated based on the data signal corresponding to the image frame when it is determined that the scene-change does not occur between the image frame and the previous image frame. For instance, the method of FIG. 1 may extract the luminance signal from the data signal corresponding to the image frame (S410), may extract the previous luminance signal from the previous data signal corresponding to the previous image frame (S420), and may calculate the luminance difference between the luminance signal and the previous luminance signal (S430). Subsequently, the method of FIG. 1 may check whether the luminance difference is less than the first reference luminance difference (S435). Here, when the luminance difference is less than the first reference luminance difference, the method of FIG. 1 may generate the final tone mapping curve FGTM1 by adding the minimum curve-change amount MIN to the previous tone mapping curve PGTM toward the tone mapping curve GTM that is calculated based on the data signal corresponding to the image frame (S440).

When, however, the luminance difference is not less than the first reference luminance difference, the method of FIG. 1 may check whether the luminance difference is greater than the second reference luminance difference that is greater than the first reference luminance difference (S445). Here, when the luminance difference is greater than the second reference luminance difference, the method of FIG. 1 may generate the final tone mapping curve FGTM2 by adding the maximum curve-change amount MAX to the previous tone mapping curve PGTM toward the tone mapping curve GTM which is calculated based on the data signal corresponding to the image frame (S450).

When the luminance difference is not greater than the second reference luminance difference (i.e., when the luminance difference is greater than the first reference luminance difference and less than the second reference luminance difference), the method of FIG. 1 may generate the final tone mapping curve FGTM3 by adding the curve-change amount CV corresponding to the luminance difference to the previous tone mapping curve PGTM toward the tone mapping curve GTM that is calculated based on the data signal corresponding to the image frame (S460). Here, the curve-change amount CV may be calculated by performing the interpolation between the maximum curve-change amount MAX and the minimum curve-change amount MIN.

For example, as illustrated in FIG. 8, the method of FIG. 1 may calculate the tone mapping curve GTM using the reference function RM based on the data signal corresponding to the image frame. If the tone mapping is performed by determining the tone mapping curve GTM that is calculated based on the data signal corresponding to the image frame as the final tone mapping curve FGTM even when the scene-change does not occur between the image frame and the previous image frame, in some cases, the flicker that the user can observe may occur because the tone mapping curves GTM and PGTM with large differences are applied to the respective image frames that implement the similar images. Thus, the method of FIG. 1 may prevent the tone mapping curves GTM and PGTM with large differences from being applied to the respective image frames that implement the similar images by generating the final tone mapping curve FGTM1, FGTM2, and FGTM3 by adding the maximum curve-change amount MAX, the minimum curve-change amount MIN, or the curve-change amount CV corresponding to the luminance difference to the previous tone mapping curve PGTM toward the tone mapping curve GTM that is calculated based on the data signal corresponding to the image frame. As a result, the method of FIG. 1 may prevent (or minimize) the flicker that the user can observe from occurring.

For convenience of description, although it is illustrated in FIG. 8 that the tone mapping curve GTM, the previous tone mapping curve PGTM, and the final tone mapping curve FGTM1, FGTM2, and FGTM3 have the C-shape curve type, exemplary embodiments are not limited thereto. For example, the tone mapping curve GTM, the previous tone mapping curve PGTM, and the final tone mapping curve FGTM1, FGTM2, and FGTM3 may have various curve types (e.g., the S-shape curve type, etc.).

Figure 9:
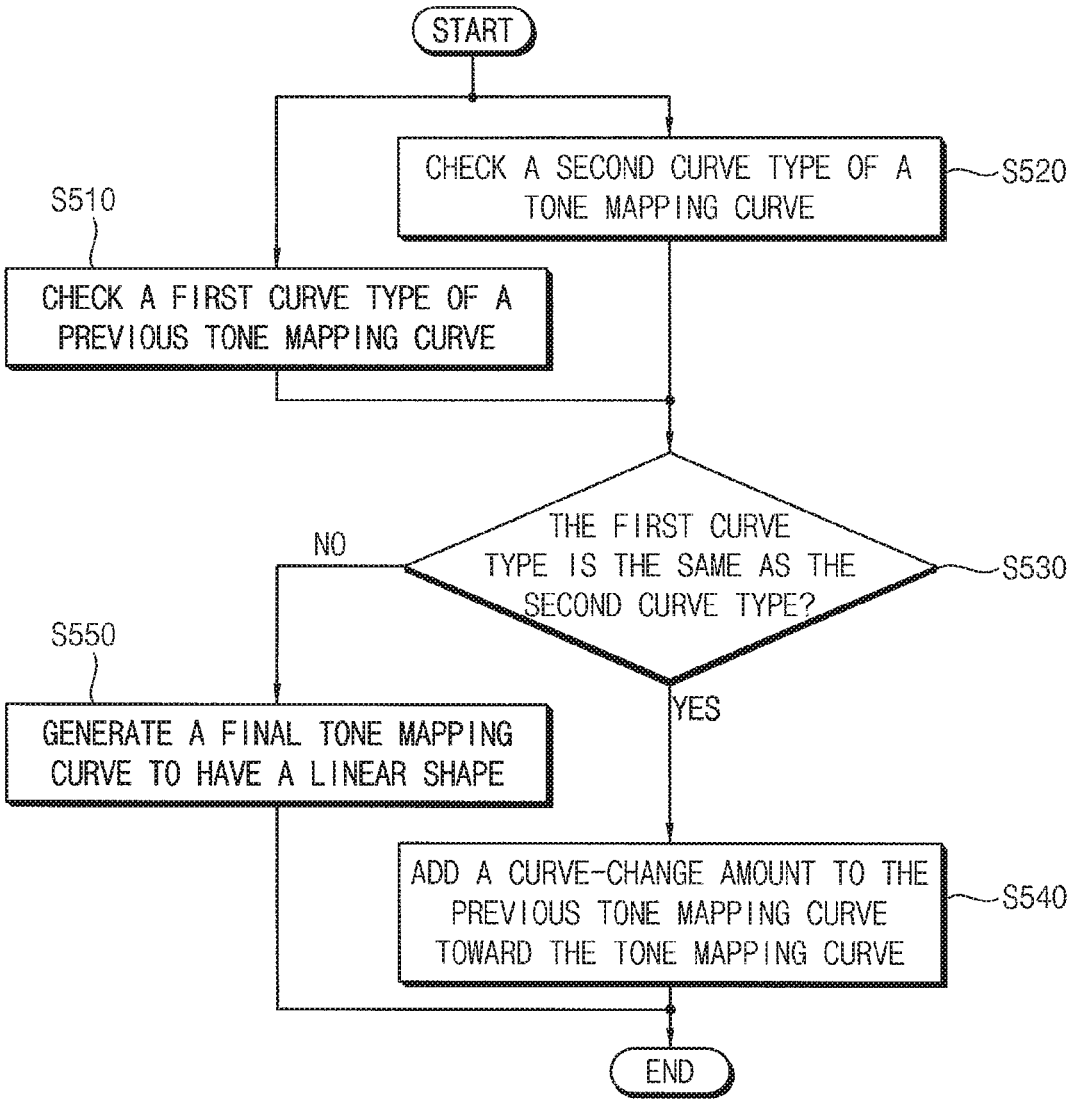
FIG. 9 is a flowchart illustrating still another example in which the method of FIG. 1 generates a final tone mapping curve according to some exemplary embodiments.
Figure 10A:
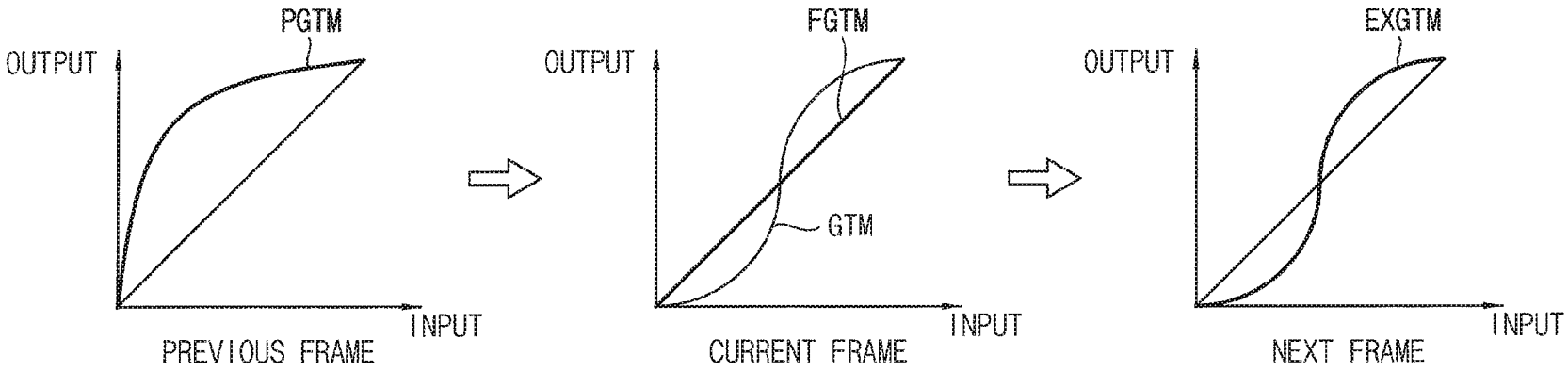
FIGS. 10A and 10B are diagrams for describing still another example in which the method of FIG. 1 generates a final tone mapping curve according to some exemplary embodiments.
Figure 10B:
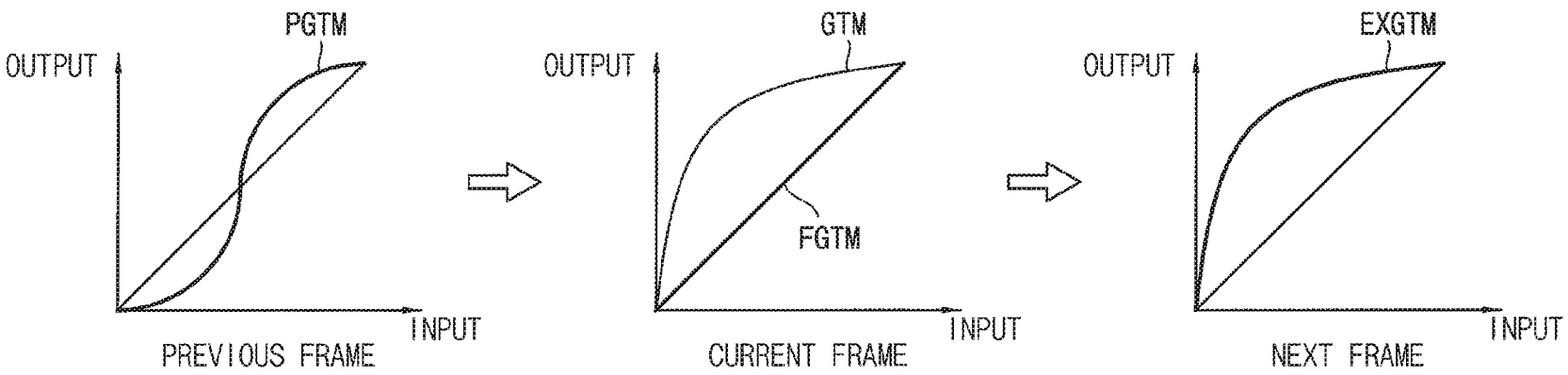

FIG. 9 is a flowchart illustrating still another example in which the method of FIG. 1 generates a final tone mapping curve according to some exemplary embodiments. FIGS. 10A and 10B are diagrams for describing still another example in which the method of FIG. 1 generates a final tone mapping curve according to some exemplary embodiments.

Referring to FIGS. 9 to 10B, the method of FIG. 1 may generate the final tone mapping curve FGTM based on the previous tone mapping curve PGTM that is applied to the previous image frame and the tone mapping curve GTM that is calculated based on the data signal corresponding to the image frame when it is determined that the scene-change does not occur between the image frame and the previous image frame. For instance, the method of FIG. 1 may check a first curve type of the previous tone mapping curve PGTM (S510), may check a second curve type of the tone mapping curve GTM that is calculated based on the data signal corresponding to the image frame (S520), and may check whether the first curve type of the previous tone mapping curve PGTM is the same as the second curve type of the tone mapping curve GTM (S530). When the first curve type of the previous tone mapping curve PGTM is the same as the second curve type of the tone mapping curve GTM, the method of FIG. 1 may generate the final tone mapping curve FGTM to be applied to the image frame by adding the curve-change amount to the previous tone mapping curve PGTM toward the tone mapping curve GTM (S540).

When, however, the first curve type of the previous tone mapping curve PGTM is different from the second curve type of the tone mapping curve GTM, the method of FIG. 1 may generate the final tone mapping curve FGTM to be applied to the image frame to have the linear shape (S550). In other words, the method of FIG. 1 may not add the curve-change amount to the previous tone mapping curve PGTM toward the tone mapping curve GTM to generate the final tone mapping curve FGTM when a difference between the previous tone mapping curve PGTM and the tone mapping curve GTM that is calculated based on the data signal corresponding to the image frame is relatively large (e.g., when a curve type is changed). In this case, the method of FIG. 1 may generate the final tone mapping curve FGTM to be applied to the image frame to have the linear shape as an intermediate process.

In some exemplary embodiments, as illustrated in FIG. 10A, the first curve type of the previous tone mapping curve PGTM may be the C-shape curve type, and the second curve type of the tone mapping curve GTM may be the S-shape curve type. In this case, the tone mapping may be performed based on the tone mapping curve PGTM having the C-shape curve type for the previous image frame, the tone mapping may be performed based on the tone mapping curve FGTM having the linear shape for the current image frame, and the tone mapping may be performing based on the tone mapping curve EXGTM having the S-shape curve type for the next image frame.

In some exemplary embodiments, as illustrated in FIG. 10B, the first curve type of the previous tone mapping curve PGTM may be the S-shape curve type, and the second curve type of the tone mapping curve GTM may be the C-shape curve type. In this case, the tone mapping may be performed based on the tone mapping curve PGTM having the S-shape curve type for the previous image frame, the tone mapping may be performed based on the tone mapping curve FGTM having the linear shape for the current image frame, and the tone mapping may be performing based on the tone mapping curve EXGTM having the C-shape curve type for the next image frame.

Figure 11:
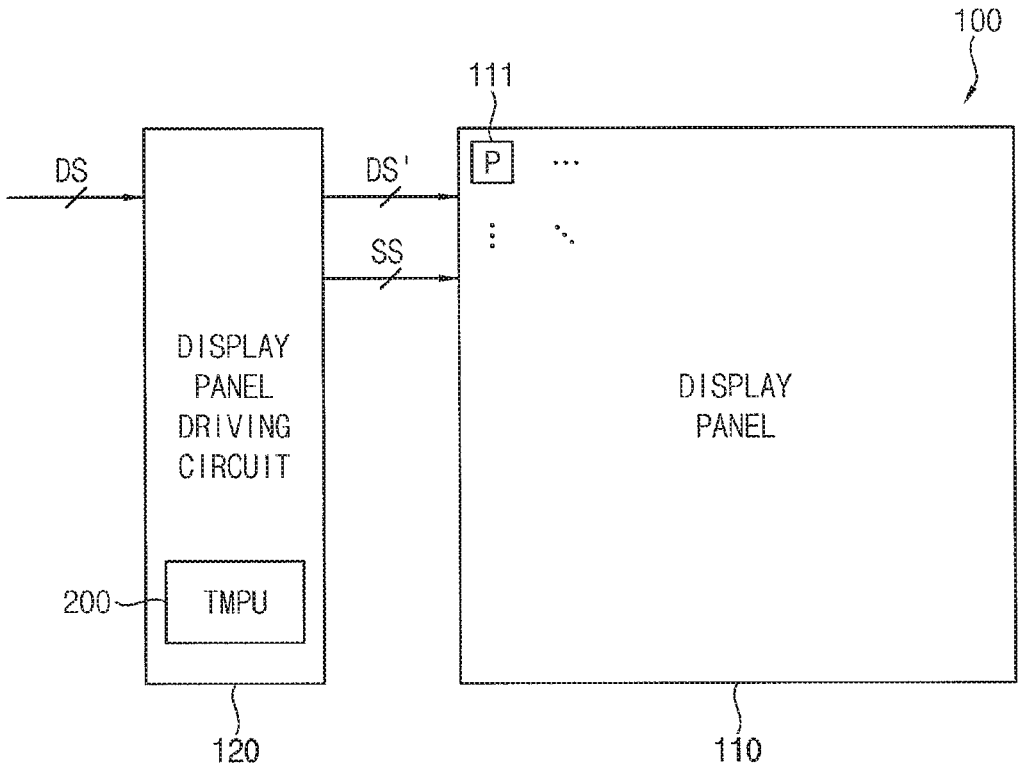
FIG. 11 is a block diagram illustrating a display device according to some exemplary embodiments.
Figure 12:
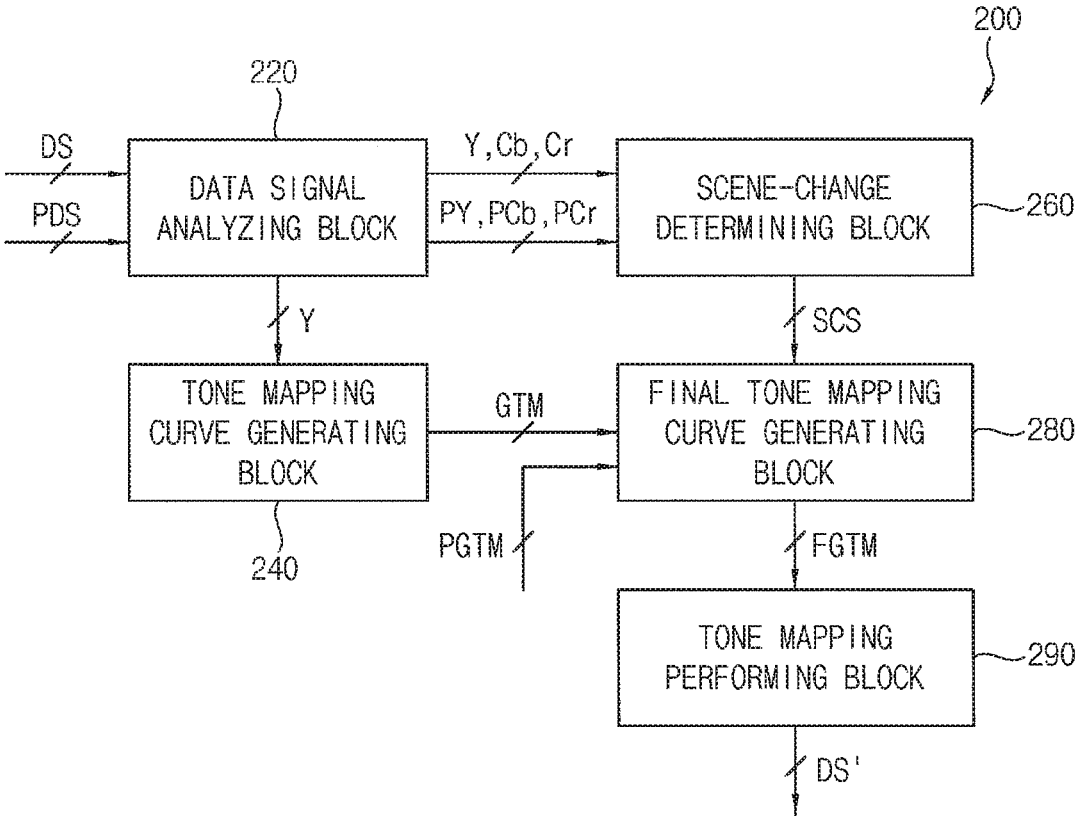
FIG. 12 is a block diagram illustrating an example of a tone mapping performing circuit of a display panel driving circuit of the display device of FIG. 11 according to some exemplary embodiments.

FIG. 11 is a block diagram illustrating a display device according to some exemplary embodiments. FIG. 12 is a block diagram illustrating an example of a tone mapping performing circuit of a display panel driving circuit of the display device of FIG. 11 according to some exemplary embodiments.

Referring to FIGS. 11 and 12, the display device 100 may include a display panel 110 and a display panel driving circuit 120. In some exemplary embodiments, the display device 100 may be an organic light emitting display (OLED) device. In some exemplary embodiments, the display device 100 may be a liquid crystal display (LCD) device. However, the display device 100 is not limited to these examples.

The display panel 110 may include a plurality of pixels 111. Here, the pixels 111 may be arranged in various forms (e.g., a matrix form, etc.) in the display panel 110. The display panel driving circuit 120 may drive the display panel 110. Although not illustrated, in some exemplary embodiments, the display panel driving circuit 120 may include a scan driver, a data driver, and a timing controller. The display panel 110 may be connected to the scan driver via scan-lines (not shown). The display panel 110 may be connected to the data driver via data-lines (not depicted). The scan driver may provide a scan signal SS to the pixels 111 included in the display panel 110 via the scan-lines. The data driver may provide a tone-mapped data signal DS' to the pixels 111 included in the display panel 110 via the data-lines. The timing controller may generate and provide a plurality of control signals to the scan driver, the data driver, etc., to control the scan driver, the data driver, etc. In some exemplary embodiments, the timing controller may perform a given processing (e.g., a deterioration compensation processing, etc.) on a data signal DS input from an external component.

In some exemplary embodiments, when the display device 100 is an organic light emitting display (OLED) device, the display panel driving circuit 120 may further include an emission control driver. In this case, the emission control driver may be connected to the display panel 110 via emission control-lines (not illustrated). The emission control driver may provide an emission control signal to the pixels 111 included in the display panel 110 via the emission control-lines. In some exemplary embodiments, when the display device 100 is a liquid crystal display (LCD) device, the display device 100 may further include a backlight unit (not shown) that radiates light to the display panel 110.

The display panel driving circuit 120 may enhance image quality by improving a contrast ratio of an image frame by performing a tone mapping on respective image frames to be displayed via the display panel 110. For example, when the data signal DS corresponding to the image frame to be displayed on the display panel 110 is an RGB signal, the display panel driving circuit 120 may perform the tone mapping on the image frame by converting the RGB signal into an YCbCr signal, converting the YCbCr signal into an Y'Cb'Cr' signal based on a final tone mapping curve, converting the Y'Cb'Cr' signal into an R'G'B' signal, and displaying the image frame based on the R'G'B' signal. To this end, the display panel driving circuit 120 may include a tone mapping performing circuit (or TPMU) 200 that performs the aforementioned operation.

For instance, the display panel driving circuit 120 (e.g., the tone mapping performing circuit 200) may calculate (or obtain) a tone mapping curve GTM based on the data signal DS corresponding to the image frame to be displayed on the display panel 110, may determine whether a scene-change occurs between the image frame and a previous image frame by comparing the data signal DS corresponding to the image frame with a previous data signal PDS corresponding to the previous image frame, may generate a final tone mapping curve FGTM based on the tone mapping curve GTM that is calculated based on the data signal DS corresponding to the image frame and the previous tone mapping curve PGTM that is applied to the previous image frame when it is determined that the scene-change does not occur between the image frame and the previous image frame, may determine the tone mapping curve GTM that is calculated based on the data signal DS corresponding to the image frame as the final tone mapping curve FGTM when it is determined that the scene-change occurs between the image frame and the previous image frame, and may perform the tone mapping by applying the final tone mapping curve FGTM to the image frame. Thus, the display panel driving circuit 120 may provide the tone-mapped data signal DS' to the pixels 111 included in the display panel 110.

In some exemplary embodiments, the tone mapping performing circuit 200 may include a data signal analyzing block 220, a tone mapping curve generating block 240, a scene-change determining block 260, a final tone mapping curve generating block 280, and a tone mapping performing block 290. The data signal analyzing block 220 may extract a luminance signal Y, a blue color-difference signal Cb, and a red color-difference signal Cr from the data signal DS by analyzing the data signal DS corresponding to the image frame and may extract a previous luminance signal PY, a previous blue color-difference signal PCb, and a previous red color-difference signal PCr from the previous data signal PDS by analyzing the previous data signal PDS corresponding to the previous image frame.

The tone mapping curve generating block 240 may receive the luminance signal Y that is extracted from the data signal DS from the data signal analyzing block 220 and may calculate the tone mapping curve GTM based on the luminance signal Y. In an exemplary embodiment, the tone mapping curve generating block 240 may generate (or calculate) the tone mapping curve GTM by calculating an entire-grayscale luminance average, a low-grayscale luminance average, and a high-grayscale luminance average of the image frame based on the luminance signal Y and calculating a tone mapping function corresponding to the tone mapping curve GTM based on the entire-grayscale luminance average, the low-grayscale luminance average, and the high-grayscale luminance average of the image frame. Here, the tone mapping curve generating block 240 may calculate the entire-grayscale luminance average of the image frame as an average of pixel-luminance of the pixels 111 included in the display panel 110 and may classify the pixels 111 included in the display panel 110 into high-grayscale luminance pixels of which the pixel-luminance is greater than the entire-grayscale luminance average of the image frame and low-grayscale luminance pixels of which the pixel-luminance is less than the entire-grayscale luminance average of the image frame. In addition, the tone mapping curve generating block 240 may calculate the low-grayscale luminance average of the image frame as an average of the pixel-luminance of the low-grayscale luminance pixels and may calculate the high-grayscale luminance average of the image frame as an average of the pixel-luminance of the high-grayscale luminance pixels.

The scene-change determining block 260 may generate a scene-change result signal SCS indicating whether the scene-change occurs between the image frame and the previous image frame by comparing the data signal DS corresponding to the image frame with the previous data signal PDS corresponding to the previous image frame. In some exemplary embodiments, the scene-change determining block 260 may receive the luminance signal Y, the blue color-difference signal Cb, and the red color-difference signal Cr that are extracted from the data signal DS from the data signal analyzing block 220, may receive the previous luminance signal PY, the previous blue color-difference signal PCb, and the previous red color-difference signal PCr that are extracted from the previous data signal PDS from the data signal analyzing block 220, may calculate a luminance difference between the luminance signal Y and the previous luminance signal PY, a blue color-difference difference between the blue color-difference signal Cb and the previous blue color-difference signal PCb, and a red color-difference difference between the red color-difference signal Cr and the previous red color-difference signal PCr, and may determine whether the scene-change occurs between the image frame and the previous image frame based on the luminance difference, the blue color-difference difference, and the red color-difference difference.

The scene-change determining block 260 may generate the scene-change result signal SCS indicating that the scene-change does not occur between the image frame and the previous image frame when the luminance difference is less than a reference luminance difference, when the blue color-difference difference is less than a reference blue color-difference difference, and when the red color-difference difference is less than a reference red color-difference difference. On the other hand, the scene-change determining block 260 may generate the scene-change result signal SCS indicating that the scene-change occurs between the image frame and the previous image frame when the luminance difference is greater than the reference luminance difference, when the blue color-difference difference is greater than the reference blue color-difference difference, or when the red color-difference difference is greater than the reference red color-difference difference.

The final tone mapping curve generating block 280 may receive the scene-change result signal SCS output from the scene-change determining block 260 and may check whether the scene-change occurs between the image frame and the previous image frame. When it is determined that the scene-change does not occur between the image frame and the previous image frame, the final tone mapping curve generating block 280 may generate the final tone mapping curve FGTM based on the tone mapping curve GTM that is calculated based on the data signal DS corresponding to the image frame and the previous tone mapping curve PGTM that is applied to the previous image frame. In some exemplary embodiments, the final tone mapping curve generating block 280 may generate the final tone mapping curve FGTM by calculating the luminance difference between the luminance signal Y that is extracted from the data signal DS and the previous luminance signal PY that is extracted from the previous data signal PDS and adding a curve-change amount corresponding to the luminance difference to the previous tone mapping curve PGTM toward the tone mapping curve GTM. In some exemplary embodiments, the final tone mapping curve generating block 280 may generate the final tone mapping curve FGTM by calculating the luminance difference between the luminance signal Y that is extracted from the data signal DS and the previous luminance signal PY that is extracted from the previous data signal PDS, adding a minimum curve-change amount to the previous tone mapping curve PGTM toward the tone mapping curve GTM when the luminance difference is less than a first reference luminance difference, adding a maximum curve-change amount to the previous tone mapping curve PGTM toward the tone mapping curve GTM when the luminance difference is greater than a second reference luminance difference that is greater than the first reference luminance difference, and adding the curve-change amount corresponding to the luminance difference to the previous tone mapping curve PGTM toward the tone mapping curve GTM when the luminance difference is greater than the first reference luminance difference and less than the second reference luminance difference. In some exemplary embodiments, the final tone mapping curve generating block 280 may check a first curve type of the previous tone mapping curve PGTM and a second curve type of the tone mapping curve GTM, may check whether the first curve type of the previous tone mapping curve PGTM is the same as the second curve type of the tone mapping curve GTM, may generate the final tone mapping curve FGTM to be applied to the image frame by adding the curve-change amount to the previous tone mapping curve PGTM toward the tone mapping curve GTM when the first curve type of the previous tone mapping curve PGTM is the same as the second curve type of the tone mapping curve GTM, and may generate the final tone mapping curve FGTM to have a linear shape when the first curve type of the previous tone mapping curve PGTM is different from the second curve type of the tone mapping curve GTM. When, however, it is determined that the scene-change occurs between the image frame and the previous image frame, the final tone mapping curve generating block 280 may determine the tone mapping curve GTM that is calculated based on the data signal DS corresponding to the image frame as the final tone mapping curve FGTM. Since the aforementioned operations have been previously described, duplicated description related thereto will not be repeated.

The tone mapping performing block 290 may receive the final tone mapping curve FGTM from the final tone mapping curve generating block 280 and may perform the tone mapping by applying the final tone mapping curve FGTM to the image frame. As described above, the display device 100 may not determine the tone mapping curve GTM that is calculated based on the data signal DS corresponding to the image frame as the final tone mapping curve FGTM when it is determined that the scene-change does not occur between the image frame and the previous image frame. That is, the display device 100 may determine an optimal tone mapping curve, which reflects an amount of image frame variation between the tone mapping curve GTM and the previous tone mapping curve PGTM, as the final tone mapping curve FGTM when it is determined that the scene-change does not occur between the image frame and the previous image frame. Thus, although tone mapping curves with large differences may be calculated for the image frames that implement similar images, the display device 100 may gradually (or gently) change luminance between the image frames by reflecting information relating to the image frame (e.g., current image frame) and the previous image frame. As a result, the display device 100 may prevent the flicker that the user can observe from occurring when performing the tone mapping on the image frame to be displayed on the display panel 110. In this manner, the display device 100 may provide a high-quality image to the user by improving a contrast ratio of the image frame without flickers.

Although it has been described that the display device 100 includes the display panel 110 and the display panel driving circuit 120, in some exemplary embodiments, the display device 100 may further include other components (e.g., a deterioration compensating circuit that performs deterioration compensation for the pixels 111 included in the display panel 110, etc.).

Figure 13:
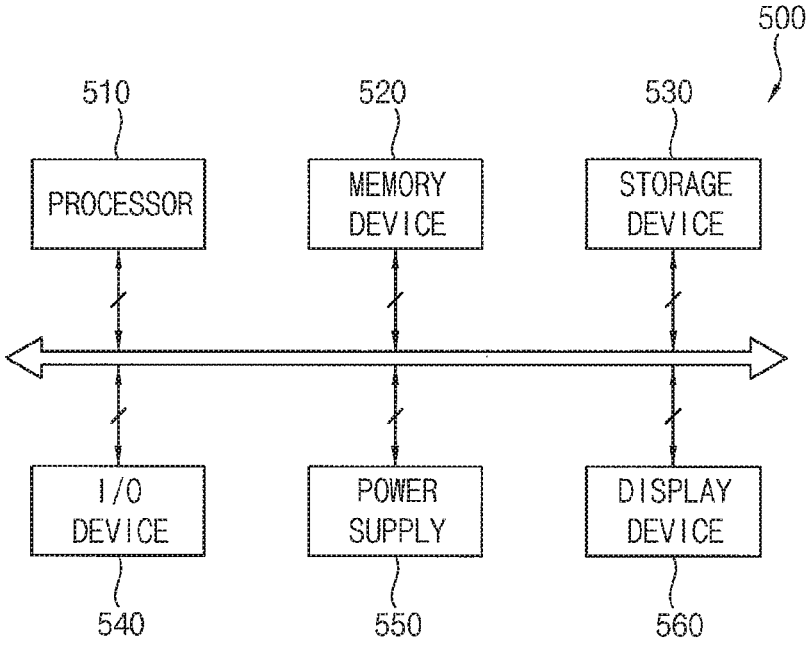
FIG. 13 is a block diagram illustrating an electronic device according to some exemplary embodiments.
Figure 14:
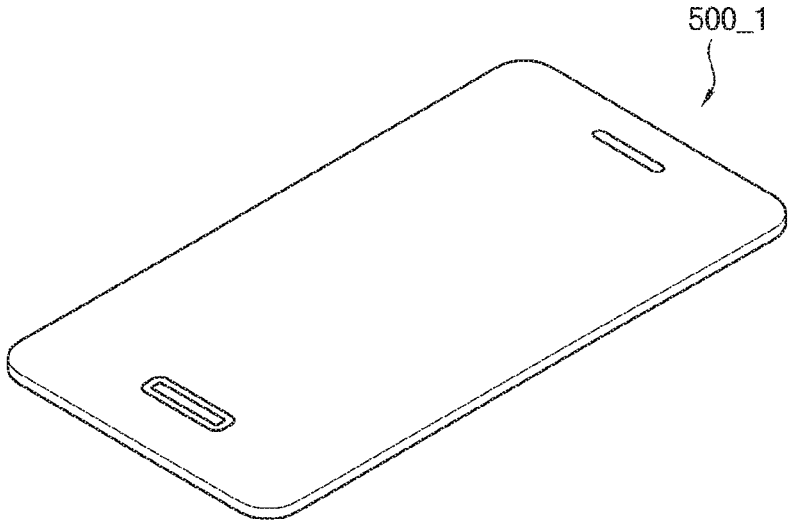
FIG. 14 is a diagram illustrating an example in which the electronic device of FIG. 13 is implemented as a smart phone according to some exemplary embodiments.
Figure 15:
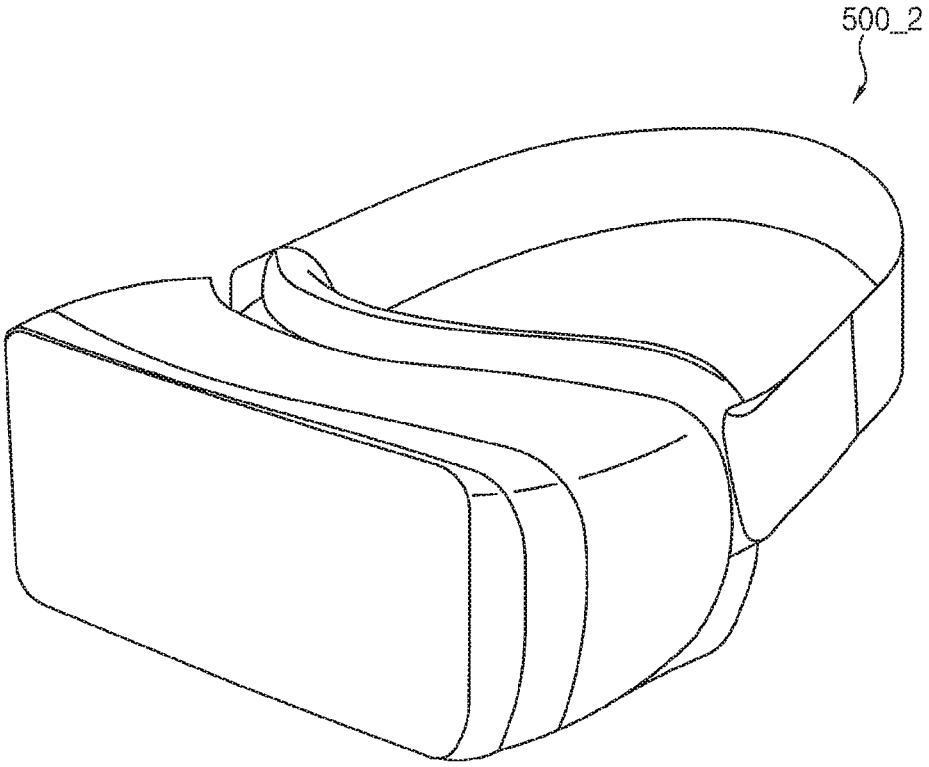
FIG. 15 is a diagram illustrating an example in which the electronic device of FIG. 13 is implemented as a head mounted display (HMD) device according to some exemplary embodiments.

FIG. 13 is a block diagram illustrating an electronic device according to some exemplary embodiments. FIG. 14 is a diagram illustrating an example in which the electronic device of FIG. 13 is implemented as a smart phone according to some exemplary embodiments. FIG. 15 is a diagram illustrating an example in which the electronic device of FIG. 13 is implemented as a head mounted display (HMD) device according to some exemplary embodiments.

Referring to FIGS. 13 to 15, the electronic device 500 may include a processor 510, a memory device 520, a storage device 530, an input/output (I/O) device 540, a power supply 550, and a display device 560. The display device 560 may be the display device 100 of FIG. 11. Although not shown, the electronic device 500 may further include a plurality of ports for communicating with a video card, a sound card, a memory card, a universal serial bus (USB) device, other electronic devices, etc. In some exemplary embodiments, as illustrated in FIG. 14, the electronic device 500 may be implemented as a smart phone 500_1. In some exemplary embodiments, as illustrated in FIG. 15, the electronic device 500 may be implemented as an HMD device 500_2. However, the electronic device 500 is not limited thereto. For example, the electronic device 500 may be implemented as a television, a cellular phone, a video phone, a smart pad, a smart watch, a tablet PC, a car navigation system, a computer monitor, a laptop, etc.

The processor 510 may perform various computing functions. The processor 510 may be a microprocessor, a central processing unit (CPU), an application processor (AP), etc. The processor 510 may be coupled to other components via an address bus, a control bus, a data bus, a main bus, etc. Further, the processor 510 may be coupled to an extended bus such as a peripheral component interconnection (PCI) bus.

The memory device 520 may store data for operations of the electronic device 500. For example, the memory device 520 may include at least one non-volatile memory device, such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device, such as a dynamic random access memory (DRAM) device, a static random access memory (SRAM) device, a mobile DRAM device, etc.

The storage device 530 may include a solid state drive (SSD) device, a hard disk drive (HDD) device, a CD-ROM device, etc. The I/O device 540 may include an input device such as a keyboard, a keypad, a mouse device, a touchpad, a touch-screen, etc., and an output device, such as a printer, a speaker, etc. In some exemplary embodiments, the display device 560 may be included in the I/O device 540. The power supply 550 may provide power for operations of the electronic device 500.

The display device 560 may be coupled to other components via the buses or other communication links. In some exemplary embodiments, the display device 560 may be an OLED device. In some exemplary embodiments, the display device 560 may be an LCD device. However, the display device 560 is not limited thereto.

As described above, the display device 560 may provide a high-quality image to a user by effectively improving a contrast ratio of an image frame without flickers by employing an image-adaptive temporal filtering processing technique. To this end, the display device 560 may include a display panel (e.g., display panel 110) and a display panel driving circuit (e.g., display panel driving circuit 120). The display panel may include a plurality of pixels. The display panel driving circuit may drive the display panel.

According to various exemplary embodiments, the display panel driving circuit may calculate (or obtain) a tone mapping curve based on a data signal corresponding to an image frame to be displayed on the display panel, may determine whether a scene-change occurs between the image frame and a previous image frame by comparing the data signal corresponding to the image frame with a previous data signal corresponding to the previous image frame, may generate a final tone mapping curve based on the tone mapping curve that is calculated based on the data signal corresponding to the image frame and a previous tone mapping curve that is applied to the previous image frame when it is determined that the scene-change does not occur between the image frame and the previous image frame, may determine the tone mapping curve that is calculated based on the data signal corresponding to the image frame as the final tone mapping curve when it is determined that the scene-change occurs between the image frame and the previous image frame, and may perform a tone mapping by applying the final tone mapping curve to the image frame.

In various exemplary embodiments, the display device 560 may not determine the tone mapping curve that is calculated based on the data signal corresponding to the image frame as the final tone mapping curve when it is determined that the scene-change does not occur between the image frame and the previous image frame. That is, the display device 560 may determine an optimal tone mapping curve, which reflects an amount of image frame variation between the tone mapping curve and the previous tone mapping curve, as the final tone mapping curve when it is determined that the scene-change does not occur between the image frame and the previous image frame. Thus, although tone mapping curves with large differences may be calculated for the image frames that implement similar images, the display device 560 may gradually (or gently) change luminance between the image frames by reflecting information relating to the image frame (e.g., current image frame) and the previous image frame. As a result, the display device 560 may prevent a flicker that a user can observe from occurring when performing a tone mapping on the image frame to be displayed on the display panel. Since the display device 560 is described above, duplicated description related thereto will not be repeated.

According to various exemplary embodiments, the inventive concepts may be applied to a display device and an electronic device including the display device. For example, various exemplary embodiments may be applied to a cellular phone, a smart phone, a video phone, a smart pad, a smart watch, a tablet PC, a car navigation system, a television, a computer monitor, a laptop, a digital camera, an HMD device, etc.

Although certain exemplary embodiments and implementations have been described herein, other embodiments and modifications will be apparent from this description. Accordingly, the inventive concepts are not limited to such embodiments, but rather to the broader scope of the accompanying claims and various obvious modifications and equivalent arrangements as would be apparent to one of ordinary skill in the art.

What is claimed is:

1. A method of performing image-adaptive tone mapping, the method comprising:

determining a tone mapping curve based on a data signal corresponding to an image frame to be displayed on a display panel;

determining whether a scene-change occurs between the image frame and a previous image frame by comparing the data signal with a previous data signal corresponding to the previous image frame;

generating, in response to a determination that the scene-change does not occur, a final tone mapping curve based on the tone mapping curve and a previous tone mapping curve applied to the previous image frame;

determining, in response to a determination that the scene-change occurs, the tone mapping curve as the final tone mapping curve; and performing a tone mapping by applying the final tone mapping curve to the image frame, wherein generating the final tone mapping curve comprises:

extracting a luminance signal from the data signal;

extracting a previous luminance signal from the previous data signal;

determining a luminance difference between the luminance signal and the previous luminance signal;

adding, in response to the luminance difference being less than a first reference luminance difference, a minimum curve-change amount to the previous tone mapping curve;

adding, in response to the luminance difference being greater than a second reference luminance difference that is greater than the first reference luminance difference, a maximum curve-change amount to the previous tone mapping curve; and adding, in response to the luminance difference being greater than the first reference luminance difference and less than the second reference luminance difference, a curve-change amount corresponding to the luminance difference to the previous tone mapping curve.

2. The method of claim 1, wherein the data signal and the previous data signal are RGB signals.

3. The method of claim 1, wherein determining the tone mapping curve comprises:

extracting a luminance signal from the data signal;

determining, for the image frame based on the luminance signal, an entire-grayscale luminance average, a low-grayscale luminance average, and a high-grayscale luminance average; and determining a tone mapping function corresponding to the tone mapping curve based on the entire-grayscale luminance average, the low-grayscale luminance average, and the high-grayscale luminance average.

4. The method of claim 3, wherein:

the entire-grayscale luminance average is determined as an average pixel-luminance of pixels included in the display panel;

some of the pixels are classified into high-grayscale luminance pixels having pixel-luminance greater than the entire-grayscale luminance average; and some of the pixels are classified into low-grayscale luminance pixels having pixel-luminance less than the entire-grayscale luminance average.

5. The method of claim 4, wherein:

the low-grayscale luminance average is determined as an average pixel-luminance of the low-grayscale luminance pixels; and the high-grayscale luminance average is determined as an average pixel-luminance of the high-grayscale luminance pixels.

6. The method of claim 1, wherein determining whether the scene-change occurs comprises:

extracting, from the data signal, a luminance signal, a blue color-difference signal, and a red color-difference signal;

extracting, from the previous data signal, a previous luminance signal, a previous blue color-difference signal, and a previous red color-difference signal;

determining a luminance difference between the luminance signal and the previous luminance signal, a blue color-difference difference between the blue color-difference signal and the previous blue color-difference signal, and a red color-difference difference between the red color-difference signal and the previous red color-difference signal; and determining whether the scene-change occurs based on the luminance difference, the blue color-difference difference, and the red color-difference difference.

7. The method of claim 6, wherein it is determined that the scene-change does not occur in response to:

the luminance difference being less than a reference luminance difference;

the blue color-difference difference being less than a reference blue color-difference difference; and the red color-difference difference being less than a reference red color-difference difference.

8. The method of claim 6, wherein it is determined that the scene-change occurs in response to:

the luminance difference being greater than the reference luminance difference;

the blue color-difference difference being greater than the reference blue color-difference difference; or the red color-difference difference being greater than the reference red color-difference difference.

9. The method of claim 1, wherein generating the final tone mapping curve comprises:

extracting a luminance signal from the data signal;

extracting a previous luminance signal from the previous data signal;

determining a luminance difference between the luminance signal and the previous luminance signal; and adding a curve-change amount corresponding to the luminance difference to the previous tone mapping curve.

10. The method of claim 1, wherein the curve-change amount is determined by performing an interpolation between the minimum curve-change amount and the maximum curve-change amount.

11. A method of performing image-adaptive tone mapping, the method comprising:

determining a tone mapping curve based on a data signal corresponding to an image frame to be displayed on a display panel;

determining whether a scene-change occurs between the image frame and a previous image frame by comparing the data signal with a previous data signal corresponding to the previous image frame;

generating, in response to a determination that the scene-change does not occur, a final tone mapping curve based on the tone mapping curve and a previous tone mapping curve applied to the previous image frame;

determining, in response to a determination that the scene-change occurs, the tone mapping curve as the final tone mapping curve; and performing a tone mapping by applying the final tone mapping curve to the image frame, wherein generating the final tone mapping curve comprises:

determining a first curve type of the previous tone mapping curve;

determining a second curve type of the tone mapping curve;

determining whether the first curve type is the same as the second curve type; and generating, in response to the first curve type being different from the second curve type, the final tone mapping curve to have a linear shape, wherein the first curve type is determined one between an S-shape curve type and a C-shape curve type, and the second curve type is determined another one between the S-shape curve type and the C-shape curve type.

12. The method of claim 11, wherein the first curve type is determined as the S-shape curve type and the second curve type is determined as the C-shape curve type.

13. The method of claim 11, wherein the first curve type is determined as the C-shape curve type and the second curve type is determined as the S-shape curve type.

14. A display device, comprising:

a display panel comprising pixels; and a display panel driving circuit configured to drive the display panel, wherein the display panel driving circuit is configured to:

determine a tone mapping curve based on a data signal corresponding to an image frame to be displayed on the display panel;

determine whether a scene-change occurs between the image frame and a previous image frame based on a comparison of the data signal with a previous data signal corresponding to the previous image frame;

generate, in response to a determination that the scene-change does not occur, a final tone mapping curve based on the tone mapping curve and a previous tone mapping curve applied to the previous image frame;

determine, in response to a determination that the scene-change occurs, the tone mapping curve as the final tone mapping curve; and perform a tone mapping via application of the final tone mapping curve to the image frame, wherein the display panel driving circuit is configured to generate the final tone mapping curve at least via:

extraction of a luminance signal from the data signal;

extraction of a previous luminance signal from the previous data signal;

a determination of a luminance difference between the luminance signal and the previous luminance signal;

addition, in response to the luminance difference being less than a first reference luminance difference, of a minimum curve-change amount to the previous tone mapping curve;

addition, in response to the luminance difference being greater than a second reference luminance difference that is greater than the first reference luminance difference, of a maximum curve-change amount to the previous tone mapping curve; and addition, in response to the luminance difference being greater than the first reference luminance difference and less than the second reference luminance difference, of a curve-change amount corresponding to the luminance difference to the previous tone mapping curve.

15. The display device of claim 14, wherein the display panel driving circuit is configured to determine the tone mapping curve at least via:

extraction of a luminance signal from the data signal;

a determination, for the image frame based on the luminance signal, of an entire-grayscale luminance average, a low-grayscale luminance average, and a high-grayscale luminance average; and a determination of a tone mapping function corresponding to the tone mapping curve based on the entire-grayscale luminance average, the low-grayscale luminance average, and the high-grayscale luminance average.

16. The display device of claim 14, wherein the display panel driving circuit is configured to determine whether a scene-change occurs at least via:

extraction, from the data signal, of a luminance signal, a blue color-difference signal, and a red color-difference signal;

extraction, from the previous data signal, of a previous luminance signal, a previous blue color-difference signal, and a previous red color-difference signal;

a determination of a luminance difference between the luminance signal and the previous luminance signal, a blue color-difference difference between the blue color-difference signal and the previous blue color-difference signal, and a red color-difference difference between the red color-difference signal and the previous red color-difference signal; and a determination of whether the scene-change occurs based on the luminance difference, the blue color-difference difference, and the red color-difference difference.

17. The display device of claim 14, wherein the display panel driving circuit is configured to generate the final tone mapping curve at least via:

extraction of a luminance signal from the data signal;

extraction of a previous luminance signal from the previous data signal;

a determination of a luminance difference between the luminance signal and the previous luminance signal; and addition of a curve-change amount corresponding to the luminance difference to the previous tone mapping curve.

18. The display device of claim 14, wherein the display panel driving circuit is configured to:

determine a first curve type of the previous tone mapping curve;

determine a second curve type of the tone mapping curve;

determine whether the first curve type is the same as the second curve type; and generate, in response to the first curve type being different from the second curve type, the final tone mapping curve to have a linear shape.

* * * * *